US008118145B1

(12) United States Patent
Hamamy et al.

(10) Patent No.: US 8,118,145 B1
(45) Date of Patent: Feb. 21, 2012

(54) CONVERTIBLE PUSHCART LUGGAGE

(76) Inventors: Regev Hamamy, Brooklyn, NY (US); Egale Hamamy, Brooklyn, NY (US)

( * ) Notice: Subject to any disclaimer, the term of this patent is extended or adjusted under 35 U.S.C. 154(b) by 887 days.

(21) Appl. No.: 11/811,203

(22) Filed: Jun. 8, 2007

Related U.S. Application Data

(60) Provisional application No. 60/812,365, filed on Jun. 9, 2006.

(51) Int. Cl.
*A45C 9/00* (2006.01)

(52) U.S. Cl. ..... 190/18 A; 280/30; 280/647; 280/648; 280/64

(58) Field of Classification Search ..... 190/115, 190/18 A; 280/47.2, 647, 648, 64
See application file for complete search history.

(56) References Cited

U.S. PATENT DOCUMENTS

| | | | | |
|---|---|---|---|---|
| 1,875,965 | A * | 9/1932 | Waters | 292/73 |
| 2,510,754 | A * | 6/1950 | Norlin | 280/38 |
| 2,603,500 | A * | 7/1952 | Messier | 280/30 |
| 4,273,222 | A * | 6/1981 | Cassimally et al. | 190/18 A |
| 5,114,164 | A * | 5/1992 | Bothwell et al. | 280/37 |
| 5,385,220 | A * | 1/1995 | Pond et al. | 190/18 A |
| 5,547,052 | A * | 8/1996 | Latshaw | 190/108 |
| 5,934,425 | A * | 8/1999 | Sadow | 190/115 |
| 6,079,527 | A * | 6/2000 | Kuo | 190/115 |
| 6,193,033 | B1 * | 2/2001 | Sadow et al. | 190/18 A |
| 6,345,414 | B1 * | 2/2002 | Chen | 16/113.1 |
| 6,832,670 | B2 * | 12/2004 | Wolters et al. | 190/18 A |
| 7,065,827 | B2 * | 6/2006 | Hsiao | 16/44 |
| 2008/0000742 | A1 * | 1/2008 | Lee et al. | 190/18 A |

* cited by examiner

*Primary Examiner* — Tri Mai
(74) *Attorney, Agent, or Firm* — Levisohn Berger LLP

(57) ABSTRACT

A suitcase with wheels that is convertible to be a pushcart or pull-cart upon which a traveler can load other luggage items and pull or push the suitcase for easy movement of several pieces of luggage simultaneously. When the suitcase is not being used as a pushcart or pull-cart it functions as a traditional "wheelie bag."

17 Claims, 28 Drawing Sheets

CONVERTIBLE PUSHCART LUGGAGE

RELATED APPLICATIONS

The present application claims priority from U.S. Provisional Patent Application Ser. No. 60/812,365 filed on Jun. 9, 2006.

BACKGROUND OF THE INVENTION

1. Field of the Invention

The present invention relates to the field of luggage, suitcases, and to pushcarts and carts, and particularly to wheeled luggage with handlebars to facilitate movement and, stacking of additional luggage or items.

2. Description of the Related Art

Many different types of luggage, garment bags, suitcases, and the like with wheels have been developed to facilitate transportation or movement without the need for additional equipment, carts, or wagons, or the services of additional personnel. For example, upright luggage having two wheels near a bottom edge and a pair of handles by which the luggage may be pulled are well-known to make it more convenient for a person, such as a passenger in an airport or using mass transportation to move or transport the luggage. These are sometimes informally referred to as "wheelie bags." Also known are more traditional "flat" suitcases with four or more wheels at or near a bottom surface to facilitate movement and handling.

Further, carts for luggage, including pushcarts, have been developed and used for some time. For example, U.S. Pat. No. 4,523,773 discloses a luggage cart upon which luggage may be placed with two wheels and a collapsible handlebar. Also, U.S. Pat. No. 5,826,892 discloses a four-wheeled pushcart for luggage.

However, a problem remains that often a person travels with more than one suitcase, bag, garment bag, duffel bag, accessories or the like, and therefore even in the unlikely event that they all have wheels and handlebars, it is difficult for one person to transport or lug them.

Often pushcarts may be rented for a fee at airports, for example, on which luggage may be stacked and moved. However, renting such pushcarts requires finding, paying for, and returning the cart, often in a place such as an unfamiliar airport where the passenger lacks change or local currency or does not speak the local language. Further finding and renting such a rentable pushcart may require that the person leave the heavy luggage or several piece of travel items in unfamiliar, unattended, or unsafe place in order to find, rent, and bring back the rentable pushcart. Also, such rentable pushcarts may be bulky or unwieldy, or may be larger than required for the luggage than the passenger needs to move.

A further problem with many upright suitcases with two wheels and a handlebar is that such suitcases are often designed to be pulled behind the passenger, rather than pushed. Such suitcases often are designed to be pulled such that the passenger holds the handlebar with one hand behind him or her and with the suitcase supported on the bottom on two wheels. Thus the user can not watch the suitcase being pulled or any items strapped to it to verify that the wheels do not get stuck and items strapped to it do not slide off. A related problem is that such suitcases are designed to be pulled using one hand, a potentially difficult situation if the passenger is frail, sick, or elderly, or if the surface upon which the luggage is being pulled is uneven or rough.

Accordingly, there is a long-felt need to provide a piece of luggage that is easily portable either by itself or with other pieces of luggage and which may be convertible from one mode of operation to another depending on the user's needs.

SUMMARY OF THE INVENTION

The above and other problems are solved by the invention, which is a convertible pushcart suitcase. The inventive suitcase includes two or more pairs of wheels at a bottom surface of the suitcase and a handle to enable pushing of the suitcase as a pushcart. Preferably, at least one of the sets of wheels is retractable, so that the suitcase is convertible from two-wheeled "wheelie bag" to a four- (or more) wheeled pushcart. Additional luggage or travel items may be stacked onto the top of the suitcase to facilitate more convenient movement by one person of all necessary luggage and travel items. The handle may be pulled to an extended position and is selectively rotatable from 0° in the wheelie bag configuration to 90° in the pushcart configuration. In another embodiment, the inventive suitcase may be provided with an extendable handle that is free to pivot from 0° to 90° in any direction, thereby allowing for the suitcase to be pulled much like one would pull a wagon. Optionally, the main body or casing may be partially or fully removable from the frame to turn the device into an open pushcart for accommodating oversized loads.

DETAILED DESCRIPTION OF THE INVENTION

Embodiments of the present invention will now be described with reference to the above-identified figures. However, the drawings and the description herein of the invention are not intended to limit the scope of the invention. It will be understood that various modifications of the present description of the invention are possible without departing from the spirit of the invention. Also, features or steps described herein may be omitted, additional steps or features may be included, and/or features or steps described herein may be combined in a manner different from the specific combinations recited herein without departing from the spirit of the invention, all as understood by those of skill in the art.

Figure 1:
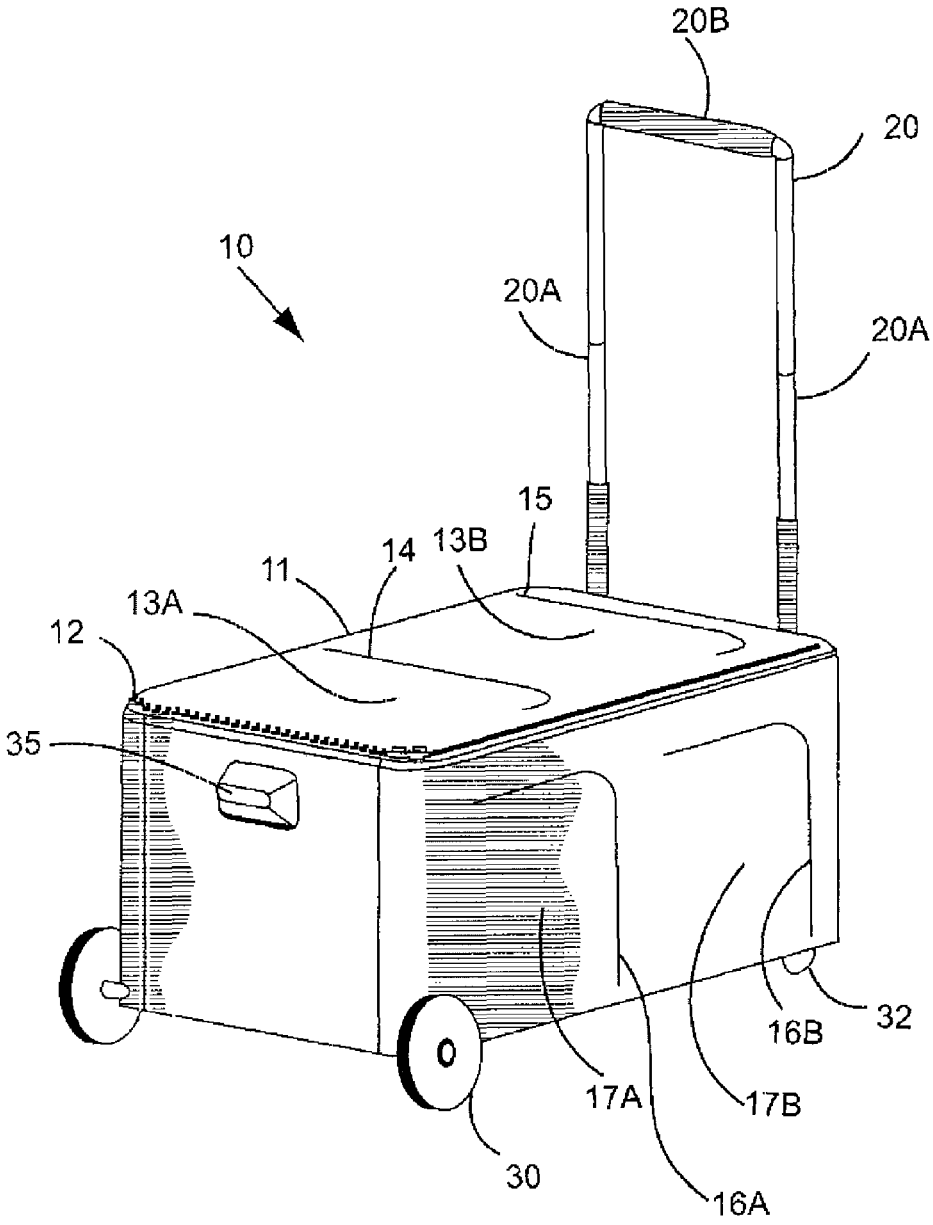
FIG. 1 is a front perspective view of a piece of pushcart luggage with the handle in a fully extended vertical position according to an aspect of the present invention.

FIG. 1 is a perspective view of an embodiment of a pushcart suitcase 10 with the handle in a fully extended and vertical position, according to an aspect of the present invention. In FIG. 1, handle 20 is extended approximately orthogonally to the main body 11 at the rear side of the pushcart suitcase 10, fixed wheels 30 are disposed near a front edge of a bottom surface 10 of the main body 11 and are attached to axle 30A towards the bottom of main body 11. Also shown in FIG. 1 is a bottom portion of one of a pair of slide-in wheel 32, which is attached to the handle 20. The main body 11 is also shown with main compartment zipper 12, and top compartments 13A and 13B disposed on a top of the main body 11 to which access is provided via zippers 14 and 15. Additionally, side compartments 17A and 17B may be accessed via zippers 16A and 16B. Also a small bumper 35 may be provided at a front side of the main body 11 to protect both the contents of suitcase 10 and whatever the suitcase is pushed into inadvertently.

Figure 2:
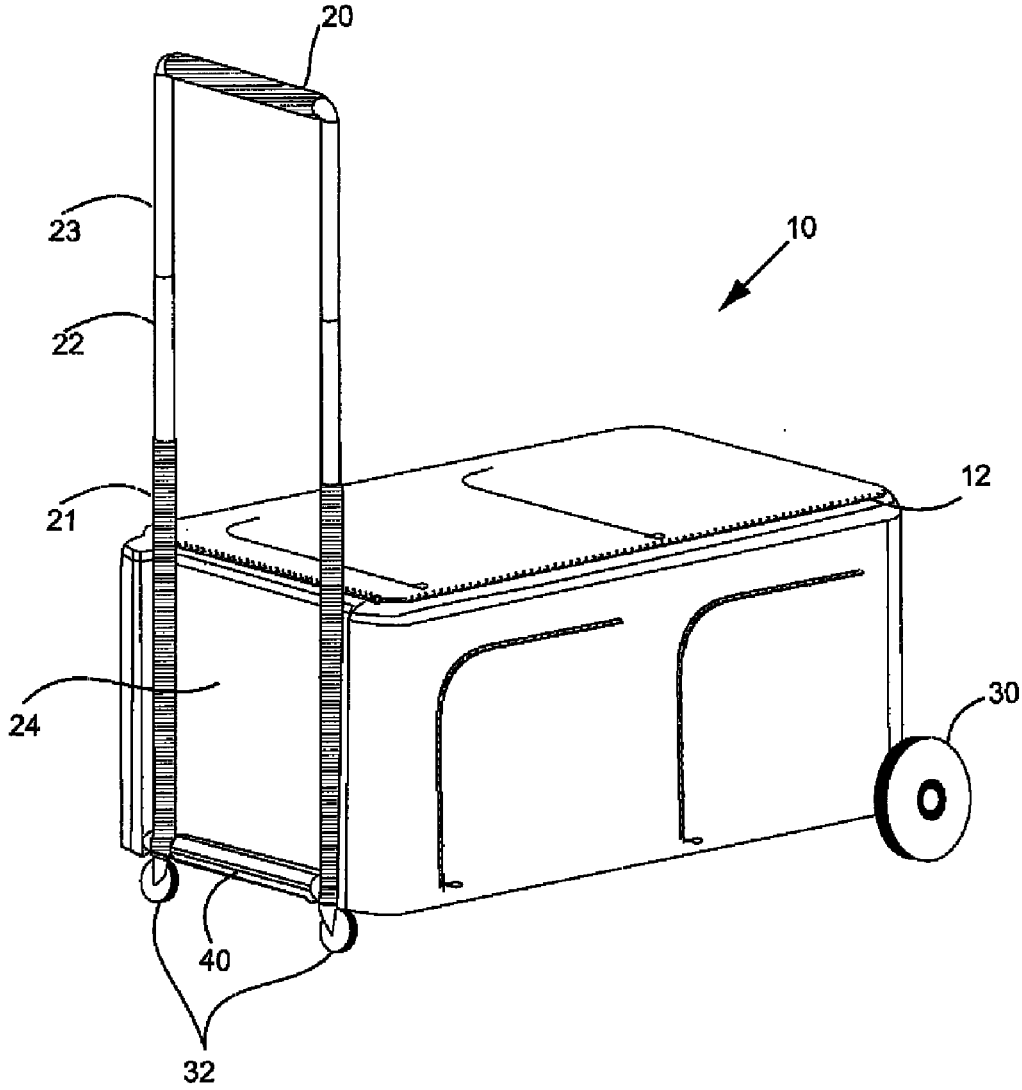
FIG. 2 is a rear perspective view of the luggage of FIG. 1 with the handle in a fully extended position, according to an aspect of the present invention.

FIG. 2 illustrates the handle 20 in the fully extended position and substantially flush against main body 11 in recess 24. Handle 20 has two telescoping, or side members 20A connected by a crossbar 20B. Note that "telescoping members" and "side members" are used interchangeably herein and refer to the side members of the handle irrespective of their ability to telescope or collapse. Each telescoping, or side member 20A includes, for example, a lower section 21, middle section 22, and top section 23. These sections of the handle 20 collapse or telescope into one another, such that the upper section 23 slides inside the middle section 22, which in turn slides into the lower section 21. However, it will be understood that the handle 20 may be designed with more than three or fewer than three such sections. Also, telescoping members 20A may comprise a single piece instead of multiple sections, such that the handle 20 is retractable into the wheel-wells 41 at the wheel-well apertures 42. The handle 20 may be made of metals and metal alloys, including aluminum, steel, titanium, or may be made of hard plastics, such as PVC or other synthetic materials, or some combination of the foregoing. For example, a top portion of the handle 20 may be wrapped in or coated with a softer material, such as textiles, synthetic fibers, nylon, mylar, plastic, leather or some combination of the foregoing.

Figure 8:
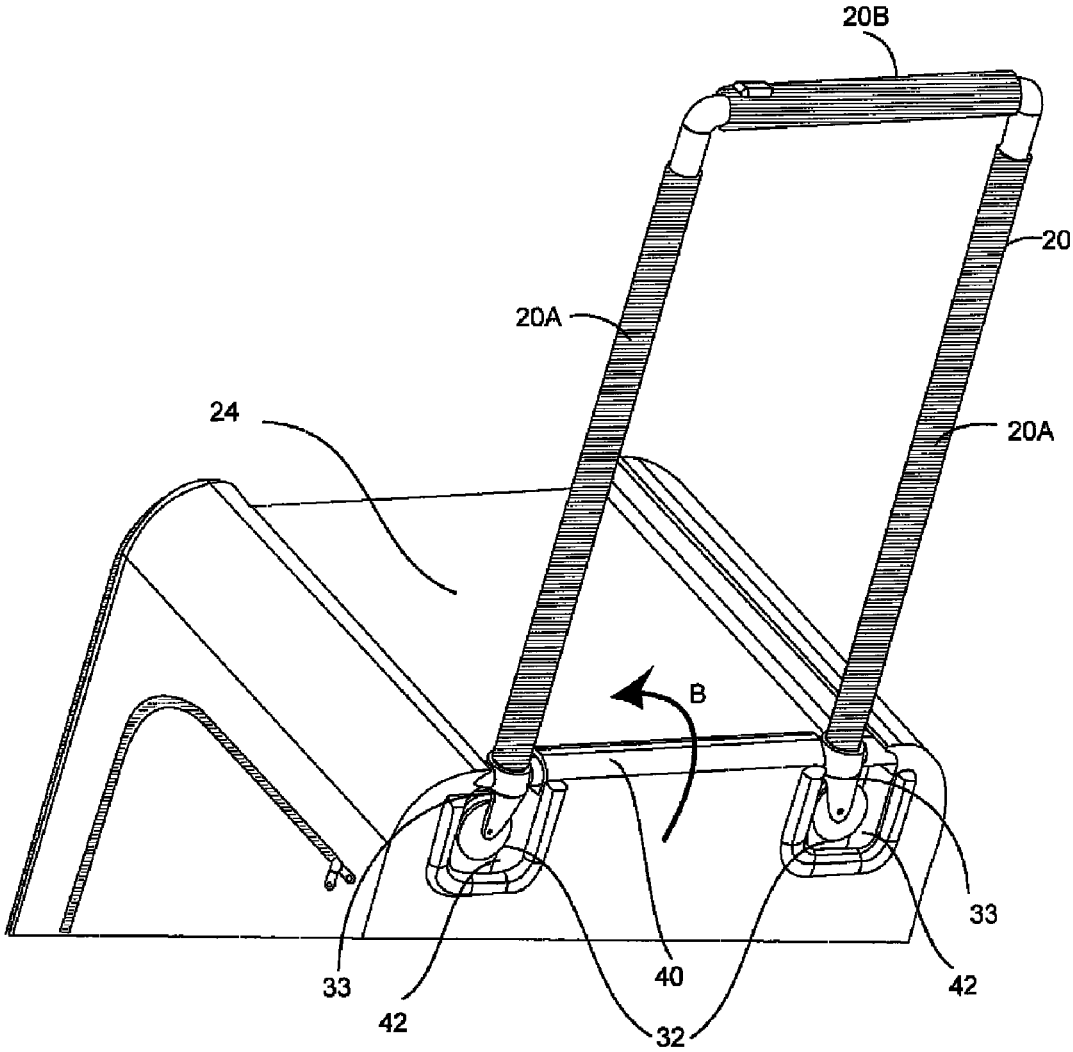
FIG. 8 is a top perspective of a portion of the luggage of FIG. 1 with the handle in a fully extended but horizontal position showing the retractable wheels, according to an aspect of the present invention.

Also shown in FIG. 2 are the slide-in wheels 32 disposed near lower bar 40. Wheels 32 are connected to the distal ends of handle members 20A and are disposed not only to be rotatable about their respective centers (as wheels commonly are) but also to be pivotable about the axes of handle members 20A. That is, as shown in FIG. 8, for example, wheels 32 are attached to the handle with casters 33 that enable the orientation of the wheels to change as the suitcase is pushed or turned, for example. Casters 33 may be free spinning, thereby allowing the wheels to pivot freely as the device is turned. In the alternative, casters 33 may be spring-biased so that wheels 32 have a default sideways orientation similar to that shown in FIGS. 2, 8, and 9. Such spring biasing force is to be weak enough so that pushing the suitcase causes the wheels to pivot in the correct front-to-back orientation to allow for smoother pushing.

It will be noted that slide-in wheels 32 are shown as smaller than fixed wheels 30 to allow for a more secure coupling of the stacked items unto the main body 11 and handle 20 of the pushcart suitcase 10. That is, the vector of force applied by the user in a forward direction when pushing the pushcart suitcase 10 may be less likely to cause the stacked items on top of the main body 11 to slide off if the main body 11 is disposed at a slight incline toward the handle. However, it will be understood that slide-in wheels 32 may be the same height or even larger than fixed wheels 30 without departing from the spirit of the present invention.

Figure 6:
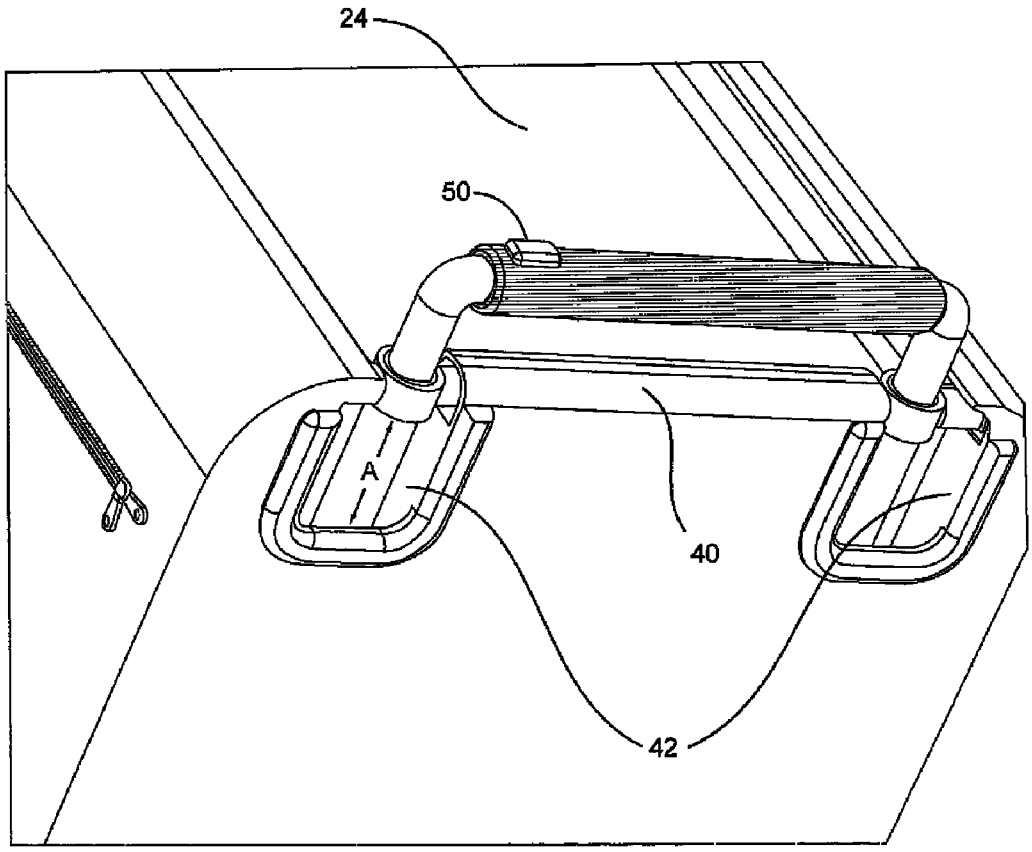
FIG. 6 is an enlarged view of a top portion of the luggage of FIG. 1 with the handle in a substantially retracted position, according to an aspect of the present invention.
Figure 9:
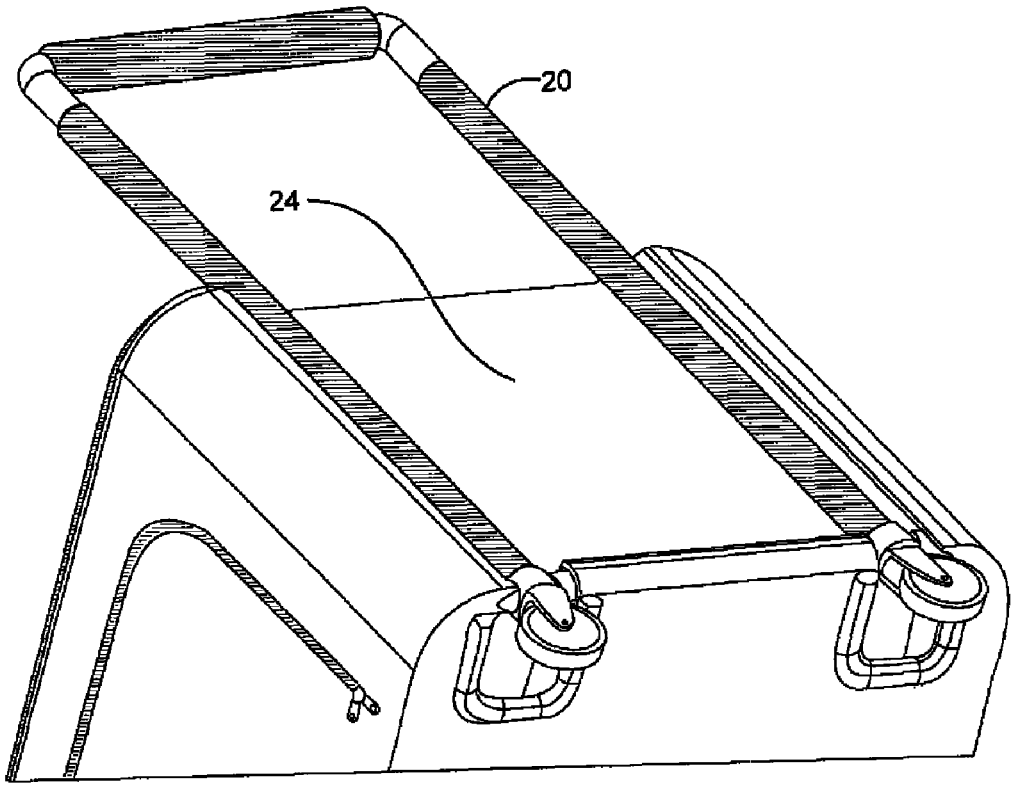
FIG. 9 is an enlarged view of the luggage of FIG. 1 with the handle in a fully extended vertical position, according to an aspect of the present invention.

FIGS. 6, 8, and 9 show how the user may convert suitcase 10 from the wheelie bag configuration (e.g., FIG. 3) to the pushcart configuration (e.g., FIGS. 1-2). When not in use, handle 20 is stored generally parallel to the bottom surface of the suitcase. In FIG. 6, handle 20 is shown protruding from the bottom portion of the main body 11 in a substantially retracted position, with the majority or entirety of members 20A being hidden within wheel wells 41 or similar channel or opening for receiving members 20A. In this configuration, suitcase 10 may be used as a wheelie bag. If the user is tall or desires a longer handle for another reason, handle 20 may be withdrawn from wheel wells 41 by pulling on crossbar 20B in the direction of arrow A of FIG. 6. When handle 20 is pulled out to the fully extended position, as shown in FIG. 8, slide-in wheels 32 at the end of the handle 20 slide out of wheel-wells 41 through the wheel-well apertures 42. The suitcase may still be used as a wheelie bag in this configuration. As shown in FIG. 8, the handle 20 may be pivoted about lower crossbar 40 in the direction of arrow B. This causes slide-in wheels to be pivoted away from wheel well apertures 42 and allows them to contact the ground if suitcase 10 is reoriented. Preferably, handle 20 is pivoted 90° about lower crossbar 40 until handle members 20A are flush with main body 11 and sitting within recess 24 to attain the pushcart configuration of pushcart suitcase 10. The fully extended vertical position of the handle 20 in recess 24 is shown in FIG. 9.

It will be understood by those skilled in the art, that handle 20 need not be housed in a wheel well or similar channel, but rather handle 20 can be positioned and stored on the outside surface of the suitcase yet be connected to the suitcase.

Optionally, the handle is provided with one or more spring-biased detent locking mechanisms which prevent the handle from accidentally moving or slipping from one position to the other. Thus, once the handle is extended, the various detent mechanisms lock the telescoping sections 21-23 in their extended configuration until and unless the user either pushes against the detent mechanisms to close them or else applies sufficient force to the top of handle crossbar 20B to collapse telescoping members 20A. Similarly, one or more detent mechanisms may be provided to lock handle 20 in one or more pivotable positions about lower crossbar 40. Thus, handle 20 may be locked in either the horizontal (wheelie bag) position or the vertical (pushcart) position; one or more intermediate angled lockable positions may also be provided.

Figure 7:
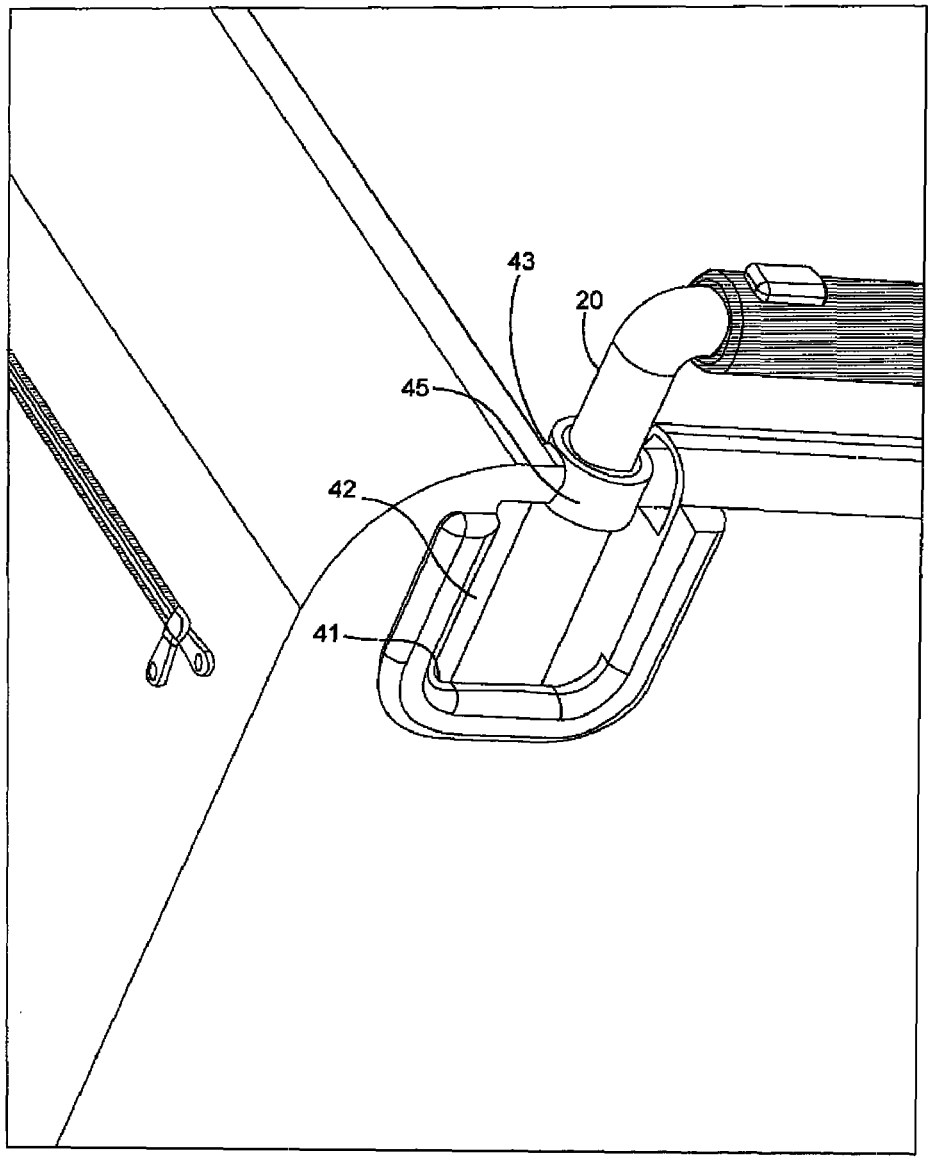
FIG. 7 is an enlarged view of a wheel-well aperture of the luggage of FIG. 1, according to an aspect of the present invention.

FIG. 6 shows handle button 50, which may be included to open the handle 20 into the first and the fully extended position. The mechanism for how the pressing of such handle button 50 opens and/or closes the handle 20 is well-known to those of ordinary skill in the art. Also, the handle button 50 may be dispensed with in favor of other controls for the handle collapsing mechanism. Similarly, FIG. 7 shows one of the apertures 42 at the head of the internal wheel-wells. Lower bar 40 pivots up when the handle 20 is pulled open to a fully extended position, thereby rotating handle 22 into the vertical position to form the pushcart configuration. Thus, in an embodiment of the invention, the handle 20 as shown in FIG. 7 is pulled through coupling ring 45 on the lower bar 40 to the extended positions. In this embodiment, when the handle 20 reaches the fully extended position, it may be pivoted up by rotating 90° coupling ring 45 together with lower bar 40 so that handle 20 aligns with a rear side of the main body 11 in the fully extended vertical position. It will be understood that lower bar 40 that rotating handle 20 can be achieved through any of various means. For example, in an embodiment, only the coupling rings 45 rotate with the lower bar 40 remaining stationary. Alternatively, handle 20 can be connected to main body 11 with hinges or the like.

During operation, the handle button 50 may be pressed once to extend the handle 20 to the first extended position, at which the handle 20 snaps into place. The handle 20 is pulled further to extend into a medium or a fully extended position. Alternatively, the handle button 50 may have the continually pressed, or pressed at the first extended position, for the handle 20 to be extended further. When the handle 20 reaches the fully extended position, the user may press the handle button 50 to tilt 90° the handle 20 to align with the main body 11. Alternatively, a second handle button (not shown) may be provided to enable the pivoting of the handle 20. One or more buttons 50 may be provided to control the various detent mechanisms described above, or the pushcart suitcase 10 may be designed such that the pivoting and/or extending of the handle 20 may be accomplished without pressing any buttons.

Figure 10:
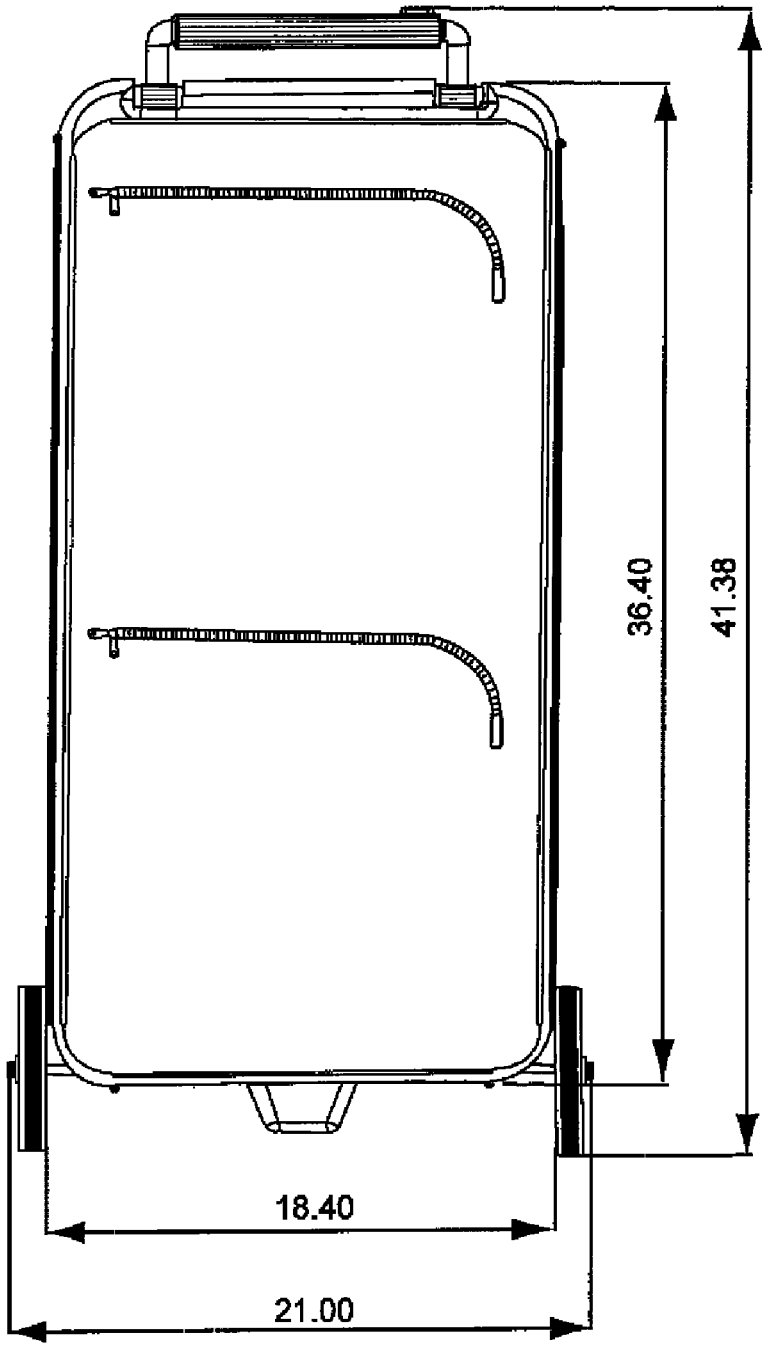
FIG. 10 is a top elevational view showing exemplary dimensions of an embodiment of a piece of pushcart luggage with the handle in a first extended position, according to an aspect of the present invention.
Figure 11:
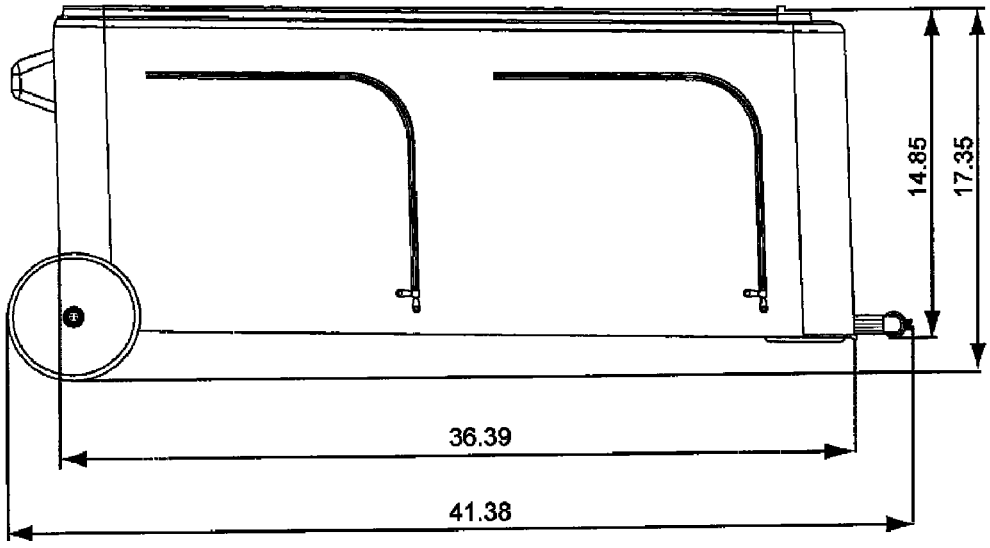
FIG. 11 is aside elevational view showing other exemplary dimensions of an embodiment of a piece of pushcart luggage, according to an aspect of the present invention.
Figure 12:
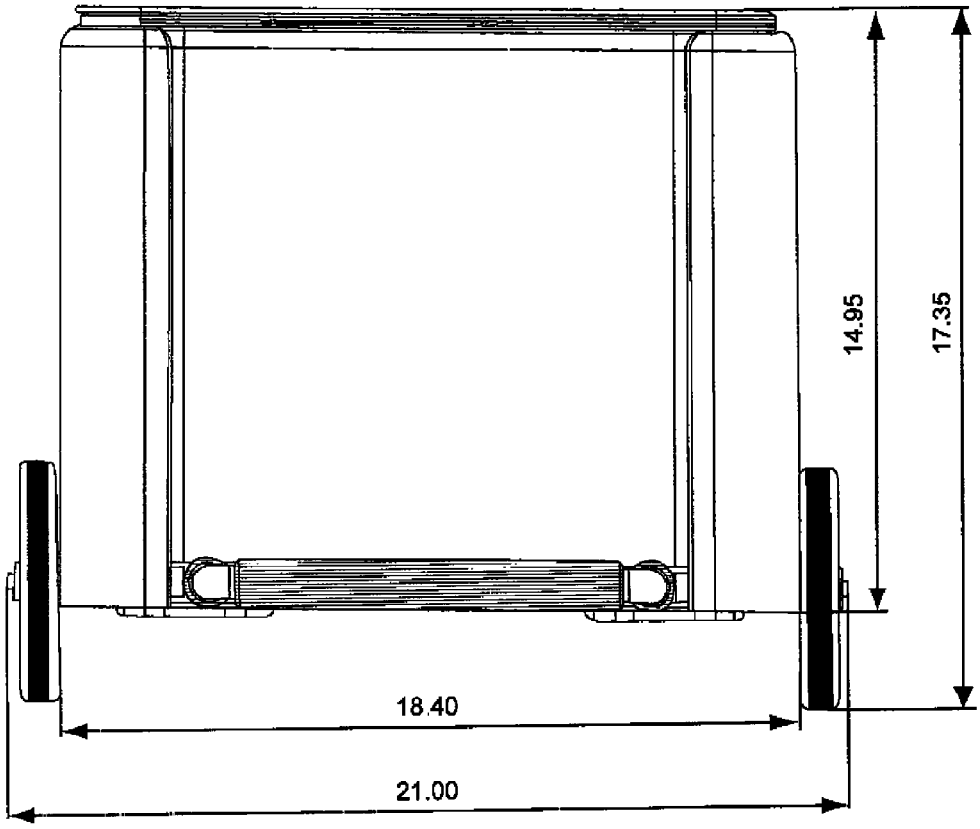
FIG. 12 is a front elevational view showing exemplary dimensions of an embodiment of a piece of pushcart luggage, according to an aspect of the present invention.

FIGS. 10-12 show exemplary dimensions for the pushcart suitcase 10, according to an embodiment of the present invention. These dimensions are provided solely to provide illustrative relationships.

Figure 3:
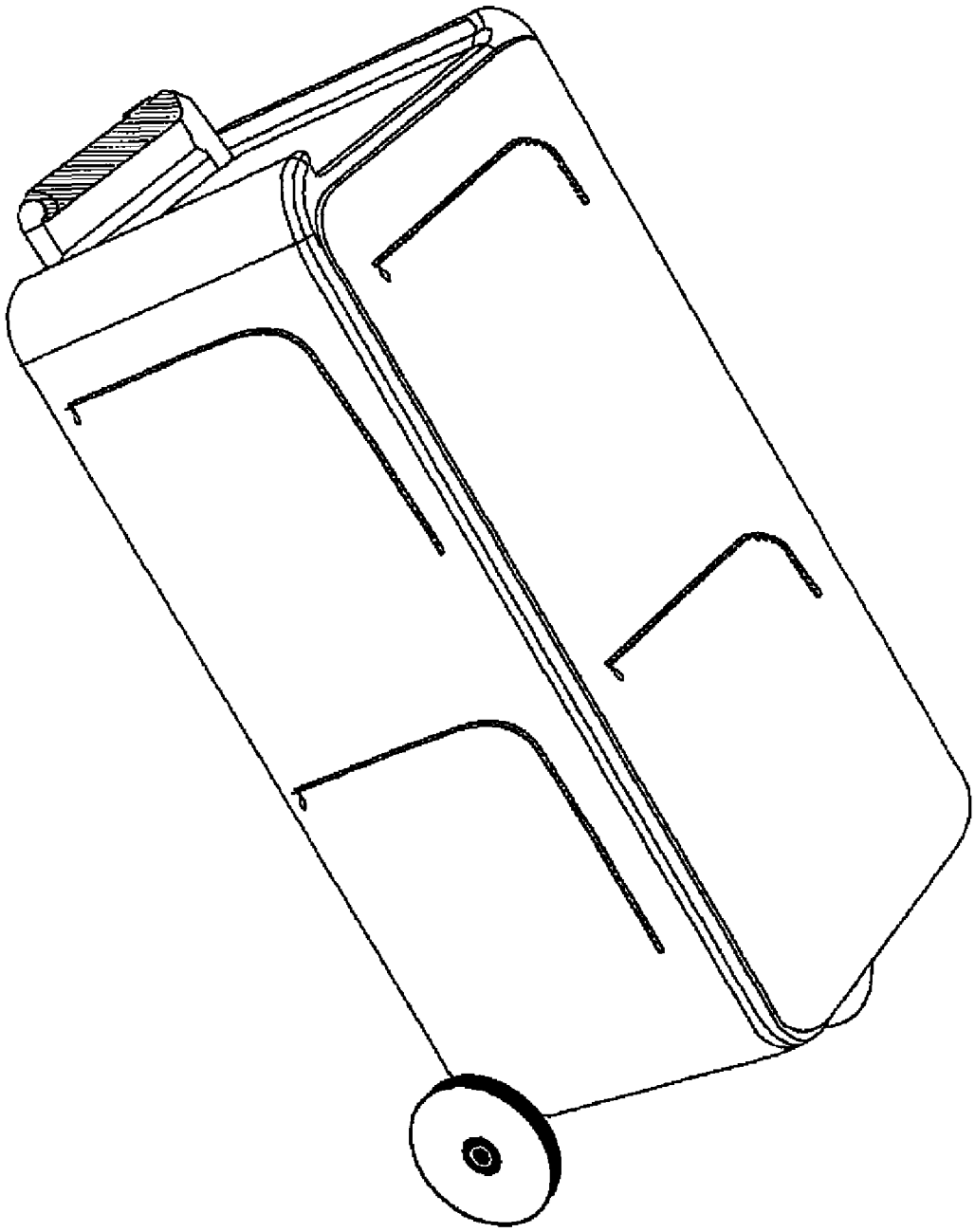
FIG. 3 is a front side perspective view of the luggage of FIG. 1 with the handle in a substantially retracted position, according to an aspect of the present invention.
Figure 4:
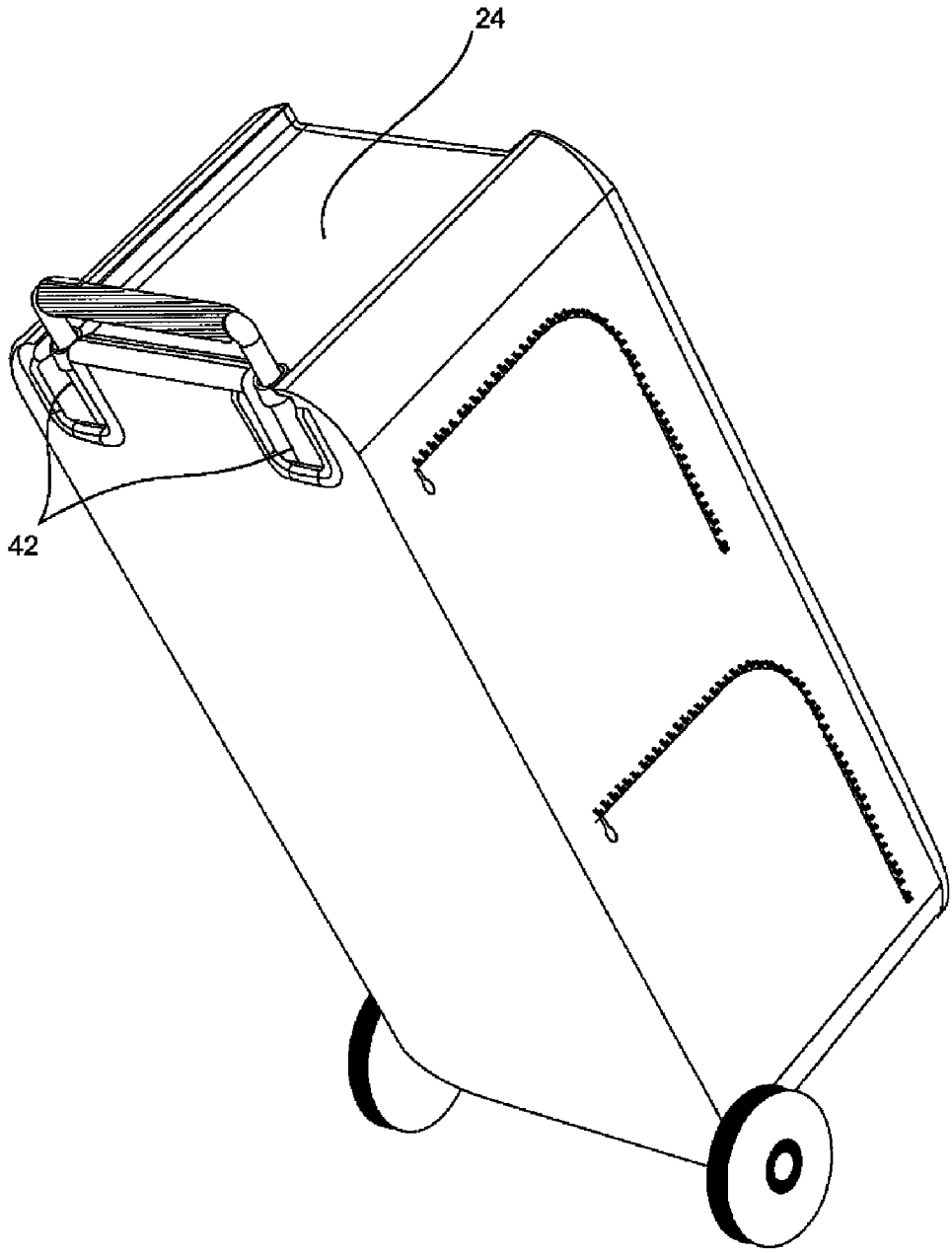
FIG. 4 is rear side perspective view of the luggage of FIG. 1 with the handle in a substantially retracted position, according to an aspect of the present invention.
Figure 5:
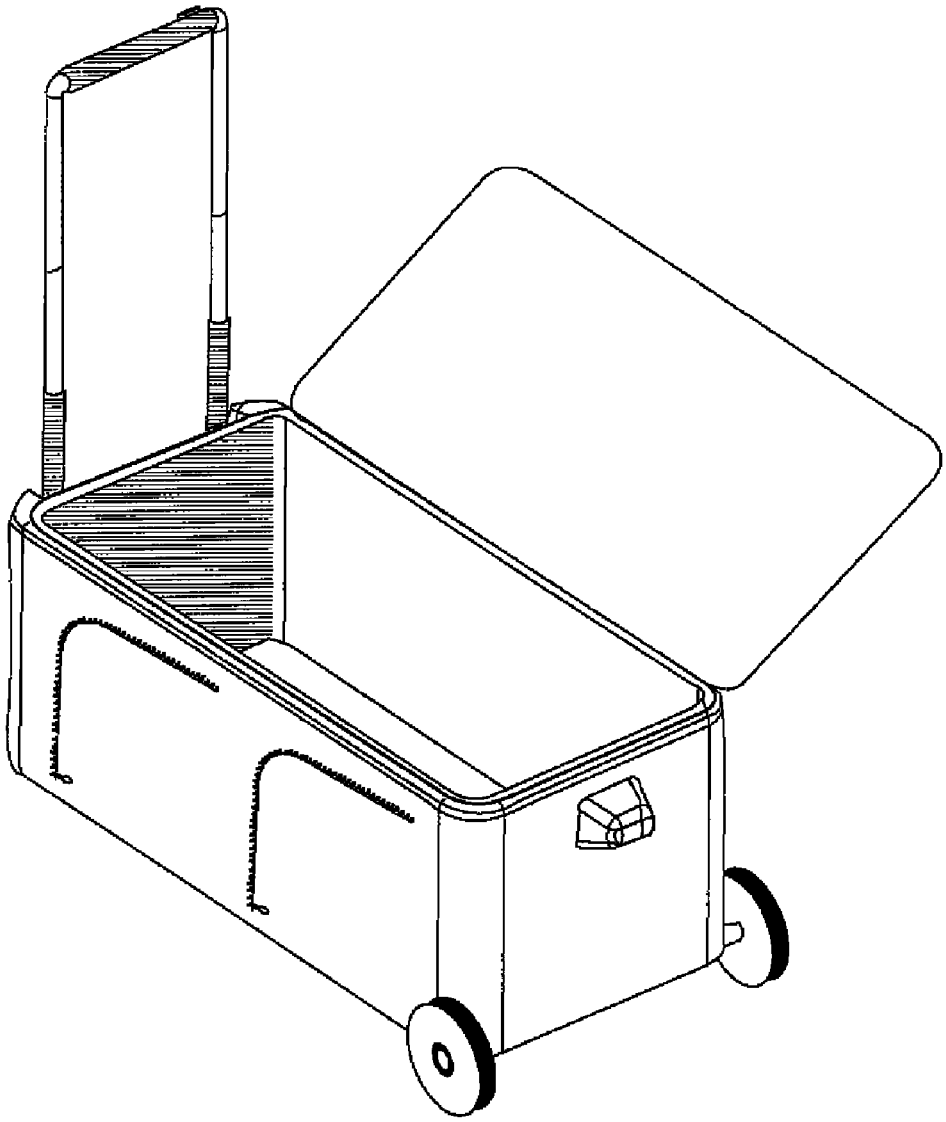
FIG. 5 is a perspective view of the luggage of FIG. 1 with the handle in a fully extended vertical position and the top of the main body open, according to an aspect of the present invention.

In operation, the invention works as follows. FIG. 3 shows the pushcart suitcase 10 with the handle 20 in the substantially retracted position. In this way, the pushcart suitcase 10 may be used in a more conventional matter akin to traditional upright luggage pulled on two fixed wheels, i.e., a wheelie bag. Should it be desired to convert suitcase 10 from wheelie bag to pushcart, the user pulls on handle crossbar 20B to extend telescoping members 20A fully as shown by arrow A in FIG. 6. Button 50 may be required to be pressed to allow handle 20 to be fully extended. Once fully extended, slide-in wheels 32 emerge from wheel wells 41. Handle 20 is then pivoted around lower crossbar 40 as shown by arrow B in FIG. 8 placing slide-in wheels 32 in substantially the same plane as fixed wheels 30. Suitcase 10 is now ready for use as a four-(or more) wheeled pushcart.

A person using pushcart suitcase 10 typically stands near the handle 20 with one or both hands on the handle 20 and faces toward the main body 10 to push pushcart suitcase 10. Other pieces of luggage, suitcases, garment bags, briefcases, knapsacks, rucksacks, duffel bags, purses, strollers, pet transportation boxes, sports equipment or the like (not shown), or even small children, may be stacked onto the pushcart suitcase 10. A strap, such as a strap with hook and loop fasteners (e.g., Velcro®), or snaps at both ends, rope, bungee cord, or the like, may further be used to secure such stacked items to the handle 20 or to other portions of the main body 11 of pushcart suitcase 10.

Accordingly, a user, such as a passenger at an airport or other terminal or station or at any other surface, would be able to handle several pieces of luggage without resort to the service of assistance personnel or the use of a separate luggage cart. Also, the user is able to see pushcart suitcase 10 and all of the articles stacked thereon to verify that they have not slid off during movement, since the pushcart suitcase 10 is pushed ahead of the user not pulled behind the user. Also, an elderly or frail user's gait may be steadied by pushing pushcart suitcase 10, since both his/her hands may be on the handle 20, and pushcart suitcase 10 may thus function as a wheeled-walker. Further, since the pushcart suitcase 10 is pushed using two hands, a more even force may be applied making it less likely that one or more of the wheels may pivot in or out. Thus the jerking of the pushcart suitcase 10 may be less likely because of pushing force exerted, and thus the sliding off of the items stacked on the pushcart suitcase 10 may be less likely.

The outer surfaces of pushcart suitcase 10 may be constructed of various materials, including plastics, mylar, PVC, fabrics, textiles, leather, synthetic leather, nylons, metals and combination of the foregoing. For example, an ABS or PP material may be used to obtain a "hard" surface for the main body 11 of the pushcart suitcase 10. Alternatively, a "soft" surface for the main body 11 may be obtained. For such a "soft" body, a frame, such as steel or plastic frame may be used to provide this strength for the pushcart suitcase 10, so that other items may be stacked on top. In addition, the outer shell or canvas of main body 11 shown in FIGS. 1-12 may be made removable and re-attachable to the frame via zippers, snaps, Velcro®, or other conventional fastening mechanisms so that suitcase 10 is fully convertible into the frame-like open pushcart 100 shown in FIGS. 13-23. Indeed, all of the components of pushcart 100 may be and preferably are incorporated into suitcase 10.

Figure 13:
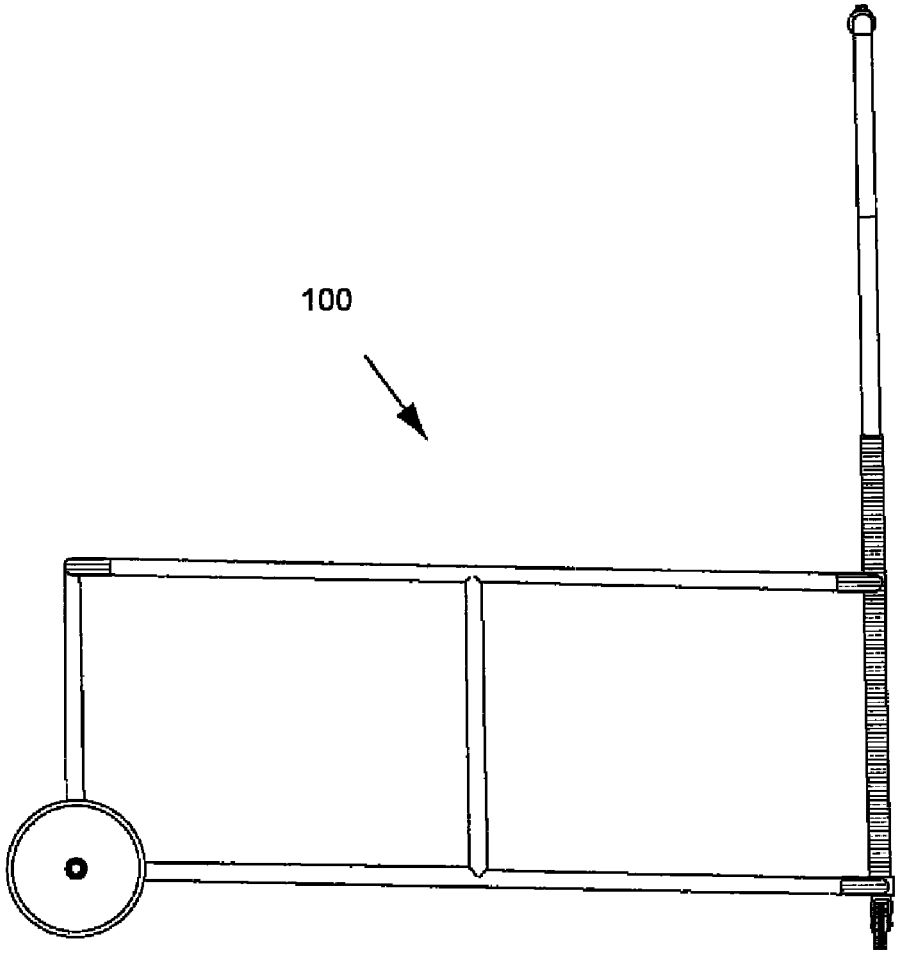
FIG. 13 is a side elevational view of a frame of a piece of pushcart luggage with the handle in a fully extended vertical position, according to an aspect of the present invention.
Figure 14:
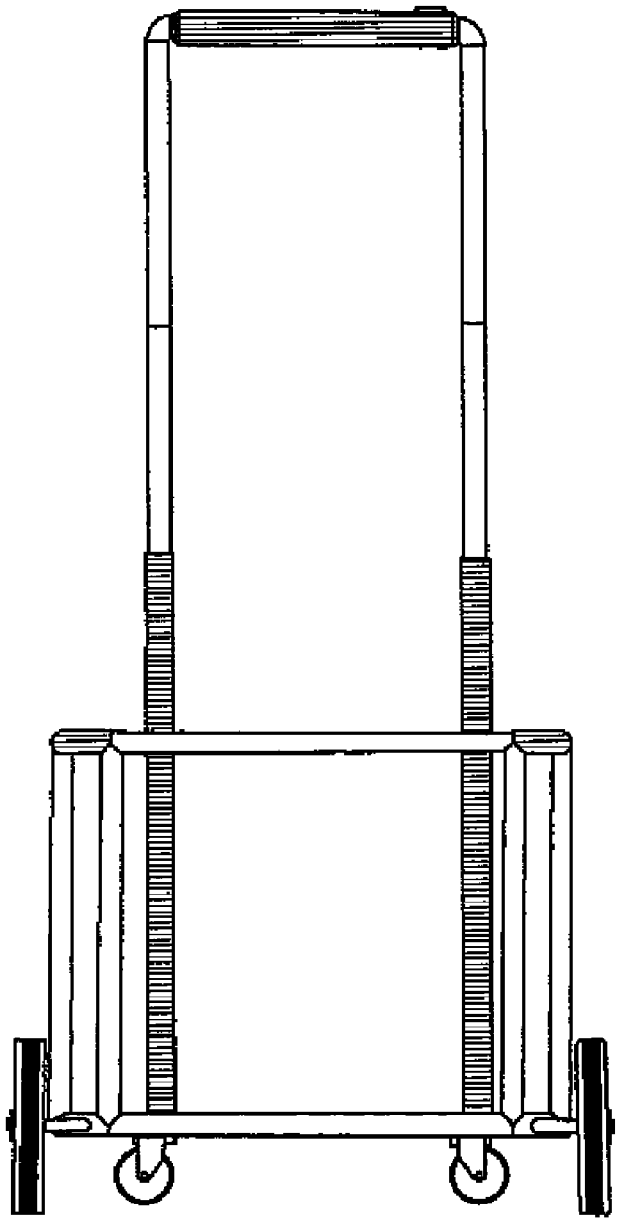
FIG. 14 is a showing the frame of FIG. 13 with the handle in a fully extended position with respect to the frame, according to an aspect of the present invention.
Figure 15:
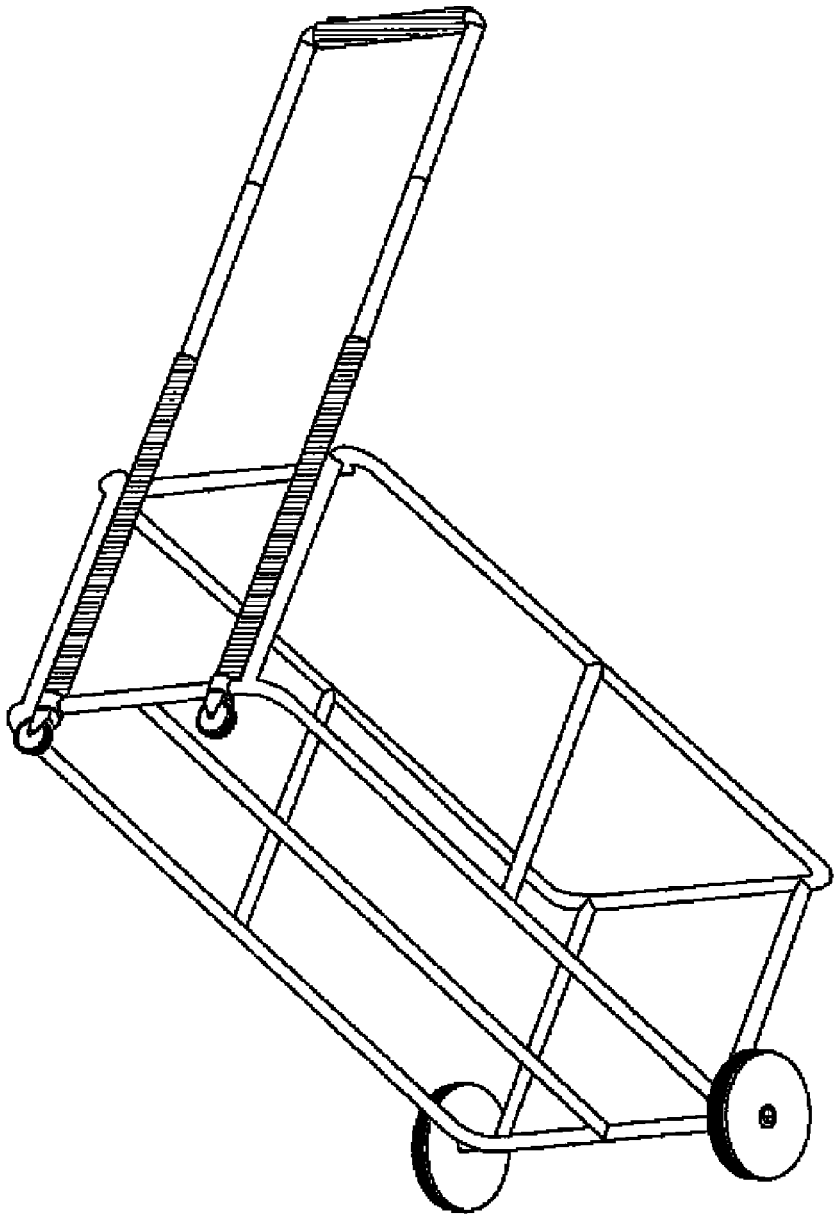
FIG. 15 is a perspective view of the frame of FIG. 13 with the handle in a fully extended vertical position, according to an aspect of the present invention.
Figure 16:
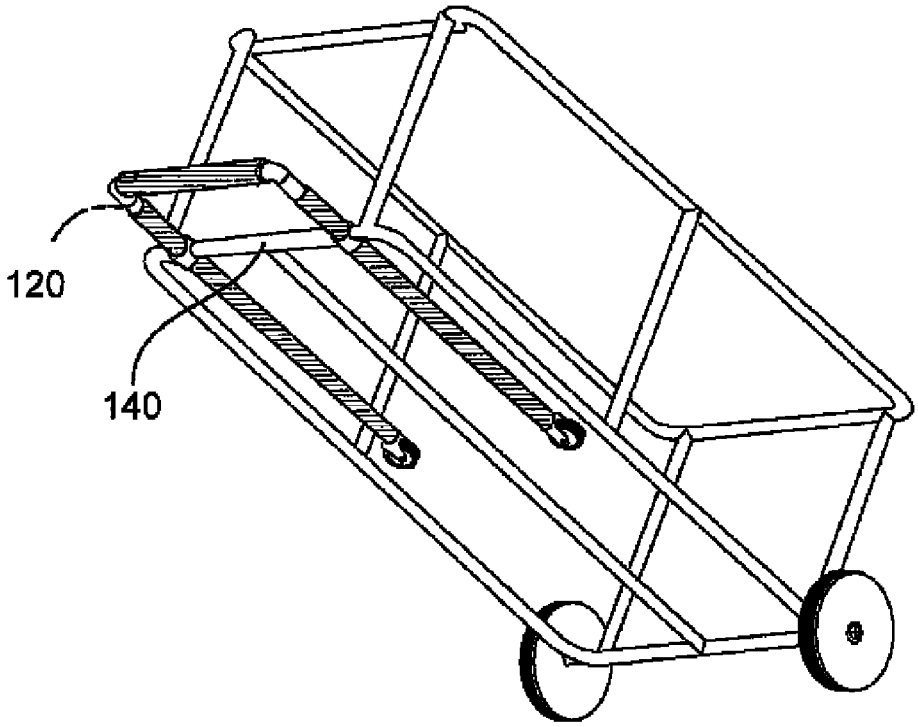
FIG. 16 is a showing a perspective view of the frame of FIGS. 13-15 with the handle in a substantially retracted position, according to an aspect of the present invention.
Figure 17:
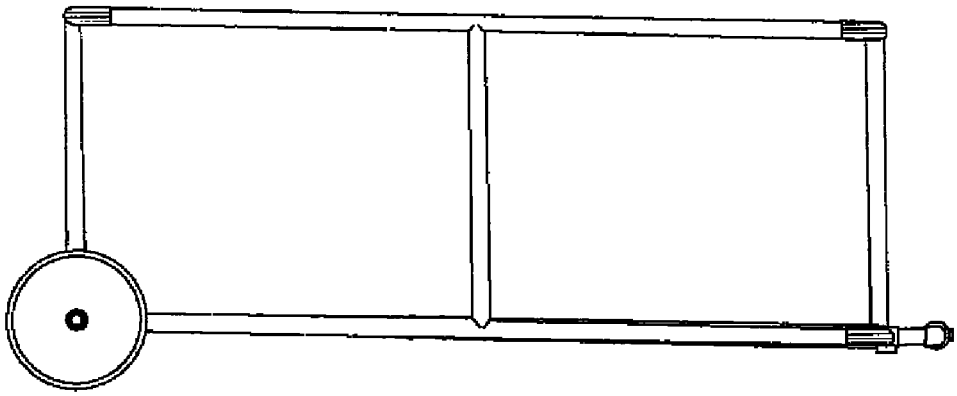
FIG. 17 is a side elevational view of the frame of FIGS. 13-16 with the handle in a first extended position, according to an aspect of the present invention.
Figure 18:
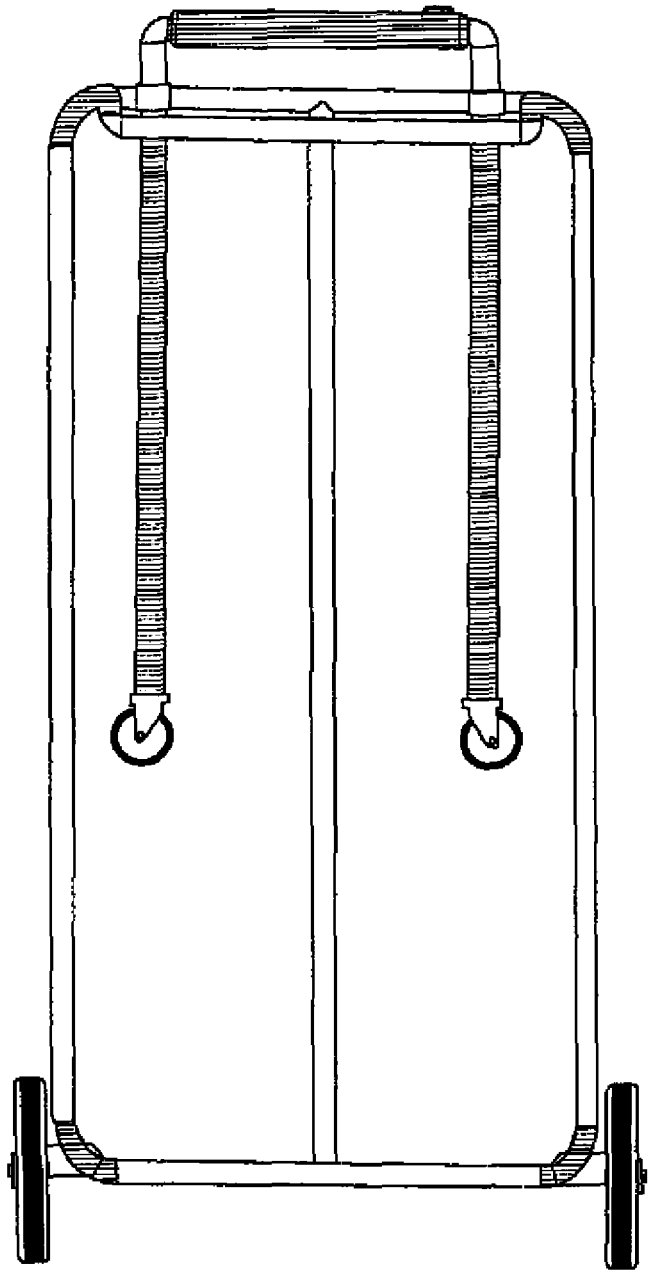
FIG. 18 is a top elevational view of the frame of FIGS. 13-16 with the handle in a substantially retracted position, according to an aspect of the present invention.
Figure 19:
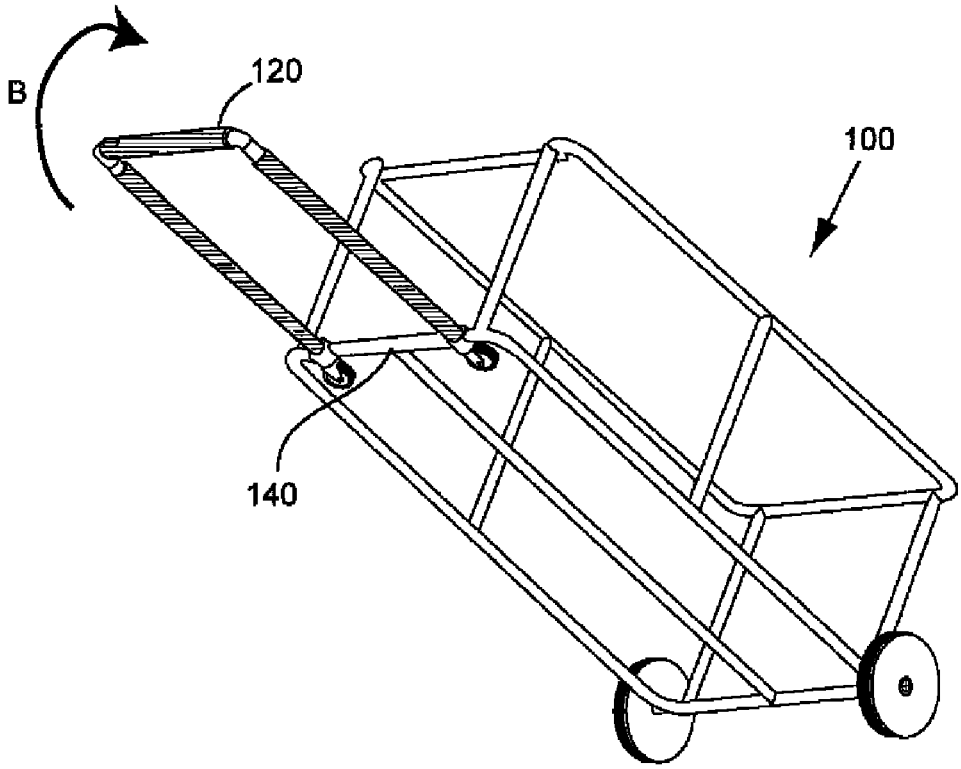
FIG. 19 is a perspective view of the frame of FIGS. 13-16 with the handle in a fully extended horizontal position, according to an aspect of the present invention.
Figure 20:
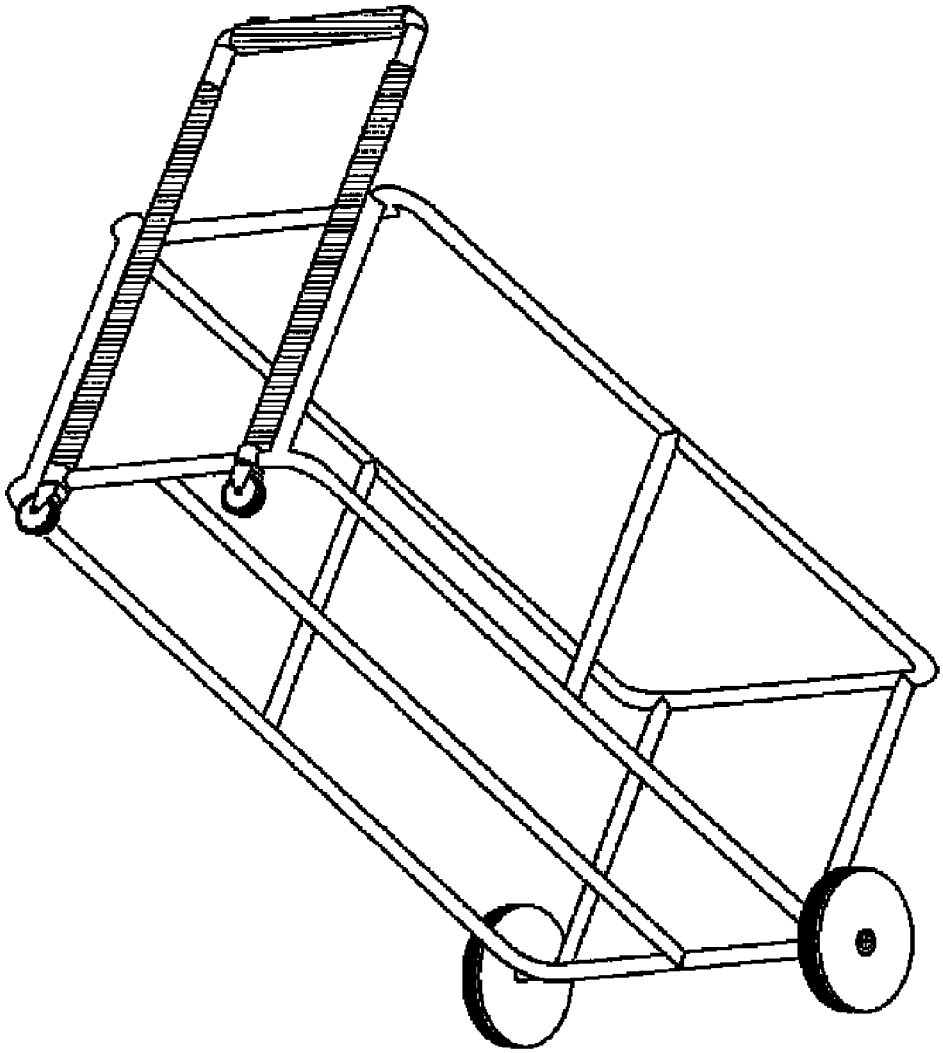
FIG. 20 is a perspective view of the frame of FIGS. 13-16 with the handle in a fully extended vertical position, according to an aspect of the present invention.
Figure 21:
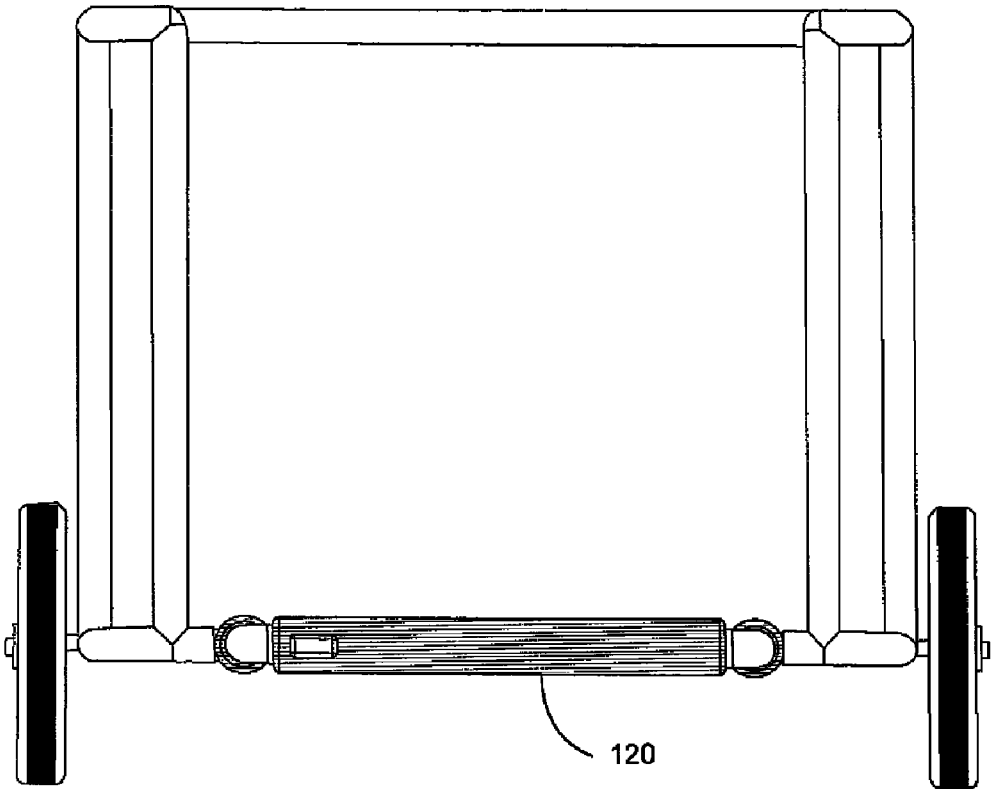
FIG. 21 is a showing a close-up rear front view of the frame of FIGS. 13-16 according to an aspect of the present invention.

FIGS. 13-23 show various views of such a frame-like pushcart 100 wherein a three-dimensional rectangular shape is defined by rigid members, substantially conforming to the size and shape of a suitcase according to an embodiment of the invention. FIGS. 13-15 show the pushcart with the handle in the fully extended vertical position with respect to the frame. FIGS. 16-18 show such a frame with the handle 120 in a substantially retracted position. FIG. 19 shows the frame with the handle 120 in the fully extended horizontal position. To convert pushcart 100 to the pushcart configuration, handle 120 is pivoted about the longitudinal axis of lower bar 140 in the direction of arrow B so that it ends up in the configuration of FIG. 20.

Figure 22:
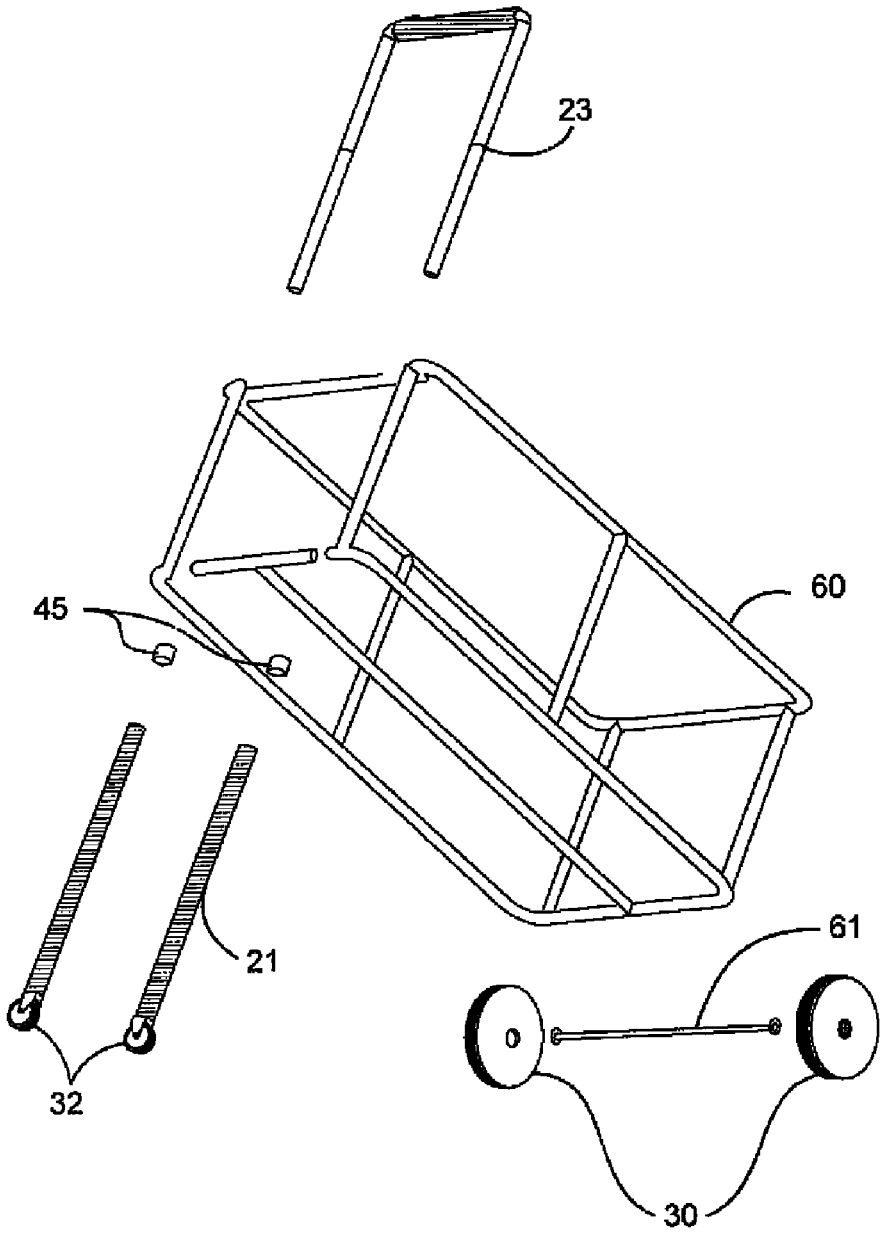
FIG. 22 is an exploded perspective view of the frame of FIGS. 13-16 according to an aspect of the present invention.

FIG. 22 shows various parts of this frame, including fixed wheel axle 61, fixed wheels 30, slide-in wheels 32, handle lower section 21, handle upper section 23, main body frame 60, and coupling rings 45.

Figure 23:
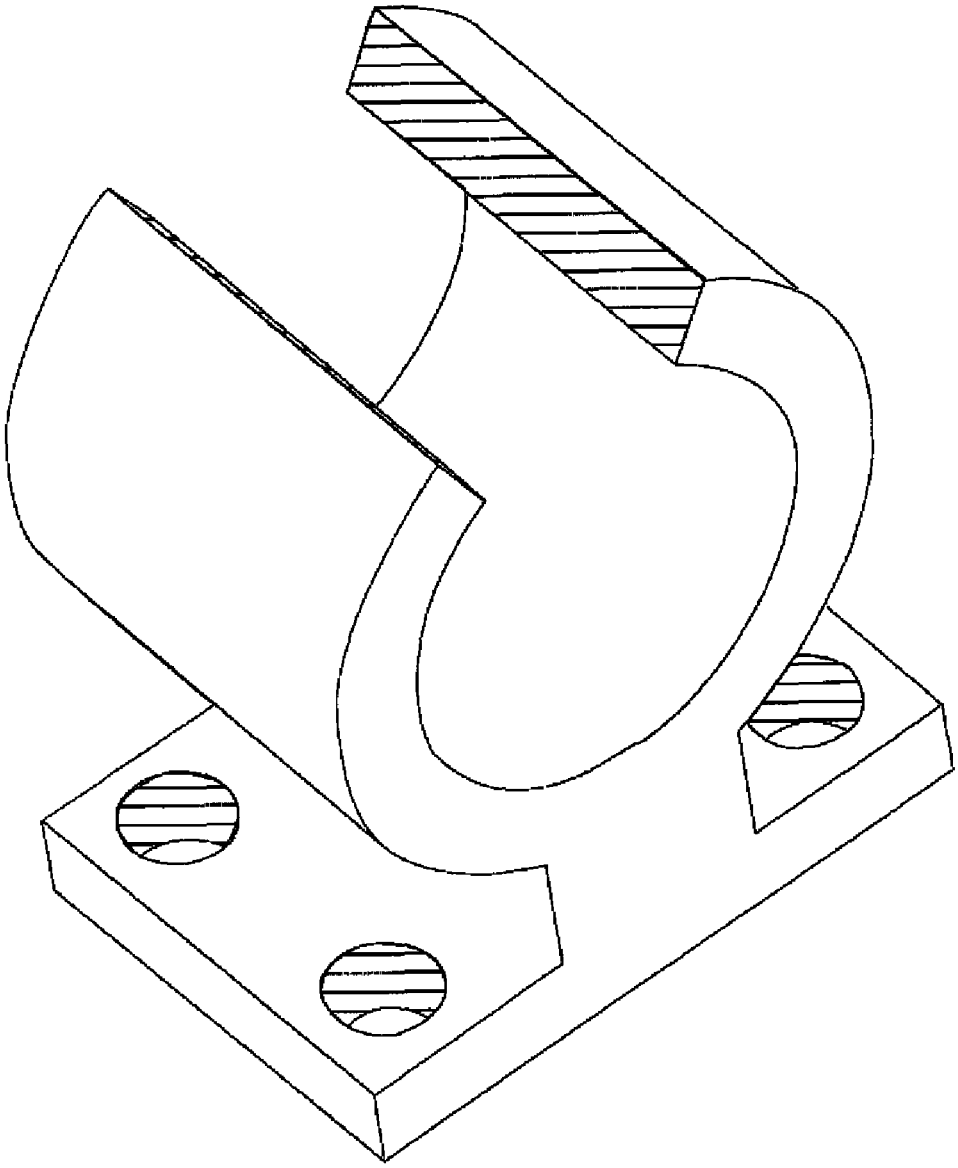
FIG. 23 is a perspective view of a c-clamp for coupling the handle about the lower cross bar of the pushcart luggage, according to an aspect of the present invention.

FIG. 23 shows a c-clamp which may be used to snap the handle 20 into position aligned with the rear surface of the main body 11 when in the fully extended and vertical position. That is, pairs of such c-clamps may be disposed on the rear or surface of the main body for receiving the handle 20 when in the pushcart configuration. It will be understood that other means may be used to secure the handle 20 in the upright (or vertical) fully extended position in the pushcart configuration, that the lower bar 43 may itself snap into position when vertical up in the pushcart configuration thereby securing the handle 20, and that alternatively, no specific securing mechanism may be necessary without departing from the spirit of the present invention.

It will be understood that slide-in wheels 32 could also be provided as a pair of fixed wheels disposed at or near a bottom all with the main body 11. For example, such a pair of fixed wheels may be aligned with or maybe spaced closer to the center of the main body 11 then the fixed wheels 30. Also additional pairs of fixed wheels may be provided at or near a middle section of the bottom of the main body 11. When the slide-in wheels 32 are instead provided as fixed wheels, they would not be attached to the handle 20, and thus smaller wheel-wells and wheel-well apertures 42 may be provided, since they would only have to accommodate the girth of the handle 20 but not the slide-in wheels 32.

Further, the slide-in wheels 32 may be alternatively provided as foldout wheels (not shown) which when unused fold in via an elbow or hinge, such that the axis of the wheels aligns with the underside of the main body 11. When the pushcart configuration of the pushcart suitcase 10 is desired, such fold-out wheels are snapped into place from their fold-in positions, by pivoting them 90° to substantially align with the fixed wheels 30. Further, the fixed wheels 30 may be provided as foldout wheels. In such an embodiment, the slide-in wheels 32 may also be embodied as slide-in wheels, fold-in wheels, or fixed wheels. Preferably, wheels 32 are disposed on the bottom surface of the main body 11 substantially on the opposite side from wheels 30.

According to another embodiment of the present invention, a pushcart handle is provided separate from the handle that is used to pull the pushcart luggage in a more conventional manner. That is, a pushcart handle as shown in FIG. 2 may be provided, and a separate handle (as shown in FIG. 6 for handle 20) may be provided for pulling the pushcart suitcase 10 or may be dispense with entirely. In this manner, the pushcart suitcase 10 may be used as a pushcart when the pushcart handle is extended and used to push the pushcart suitcase 10, or the pushcart suitcase 10 may be pulled in a more conventional manner when the traditional handle is extended and used to pull leap the luggage 10. In this way, a simpler mechanism is provided, since no tilting of a pushcart handle 20 is necessary.

Also, the pushcart handle and the separate traditional handle may be provided at the same end of the main body 11 or on opposite ends of the main body 11. For example, the pushcart handle and the separate traditional handle on the opposite end of the main body 11 could be provided in a configuration in which the pushcart suitcase 10 is equipped with four fixed wheels on the bottom.

In another embodiment, a wheelie bag suitcase as described herein is adapted to be convertible into a "pull-cart" instead of a pushcart as described herein. In this embodiment, the suitcase is pulled by way of a handle that is free to pivot about an axis, similar to the way in which a child's wagon is pulled.

Figure 24:
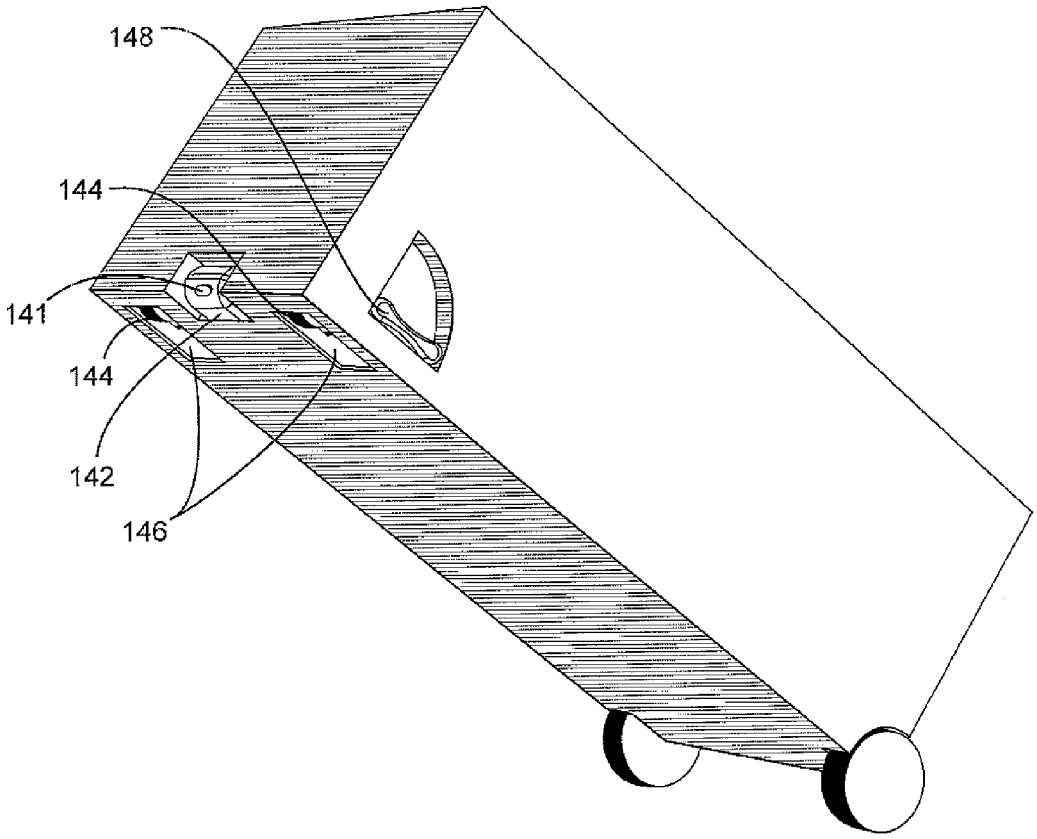
FIG. 24 is a perspective rear-side view of a pull-cart embodiment of the invention with the rear wheels in a recessed position.
Figure 25:
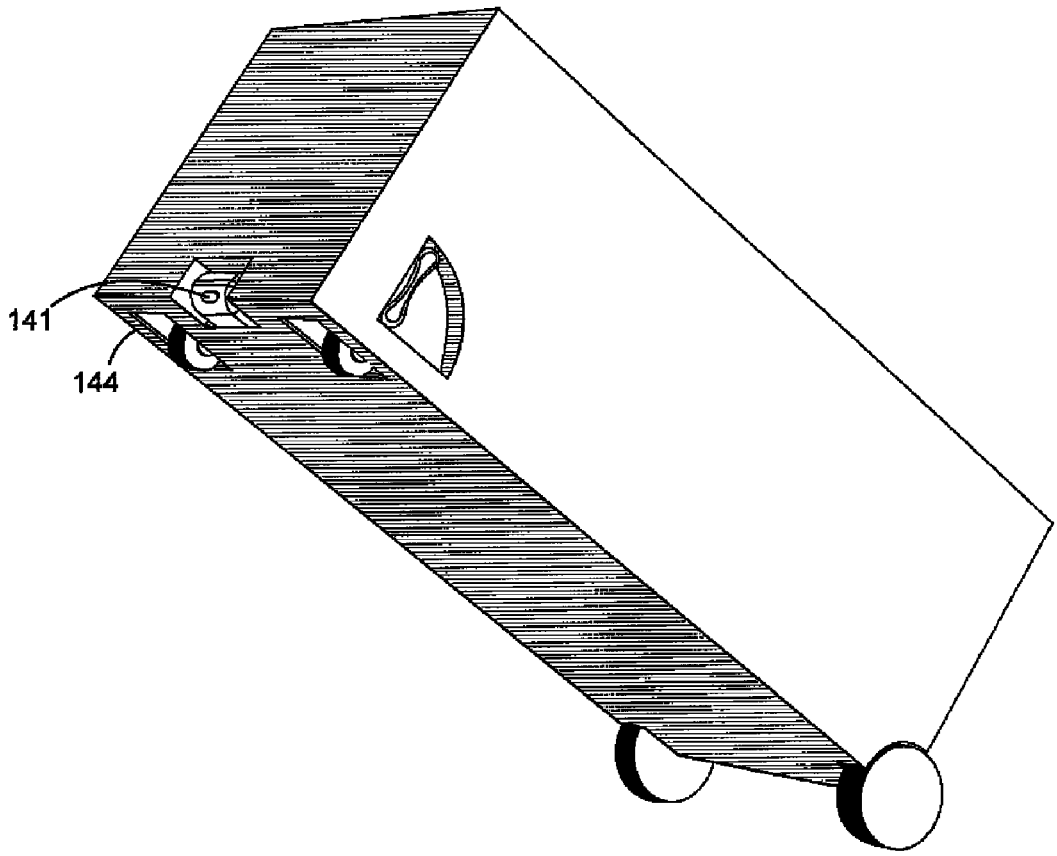
FIG. 25 is a perspective rear-side view of a pull-cart embodiment of the invention with the rear wheels in a deployed position.

FIG. 24 shows an embodiment of the pull-cart embodiment, wherein a handle member 141 is disposed in a channel 142 that extends into a bottom portion of a suitcase. Upon converting the suitcase into a pull cart, retractable wheels 144 that are disposed in a recessed surface 146 of the suitcase bottom are deployed. In a preferred embodiment, a lever 148 or similar engaging mechanism, disposed on the outside surface of a suitcase is in communication with the retractable wheels 144 and is used to deploy and/or retract the retractable wheels 144. Note that term "deployed" as pertaining to the retractable wheels herein means that the wheels are in a position such that they extend from the plane of the bottom surface of a suitcase, as shown in FIG. 25, and are as such free to contact the ground when the suitcase is placed bottom-down thereon.

It will be understood that deployed wheels 144 need not be capable of retracting into a recesses surface 146, but rather they can be fixed to the bottom surface of the suitcase. Preferably, wheels 144 are provided with casters which allow wheels 144 to pivot freely as they are turned.

Figure 26:
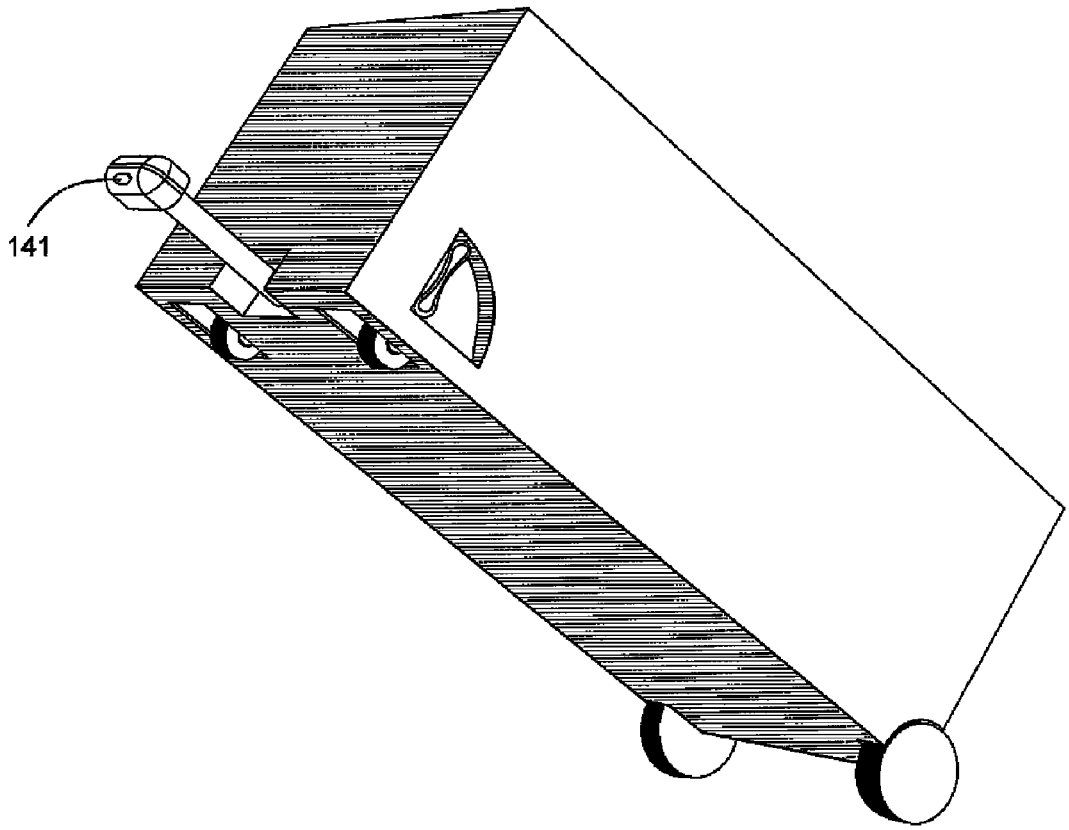
FIG. 26 is a perspective rear-side view of a pull-cart embodiment of the invention with the handle in a slightly extended position.
Figure 27:
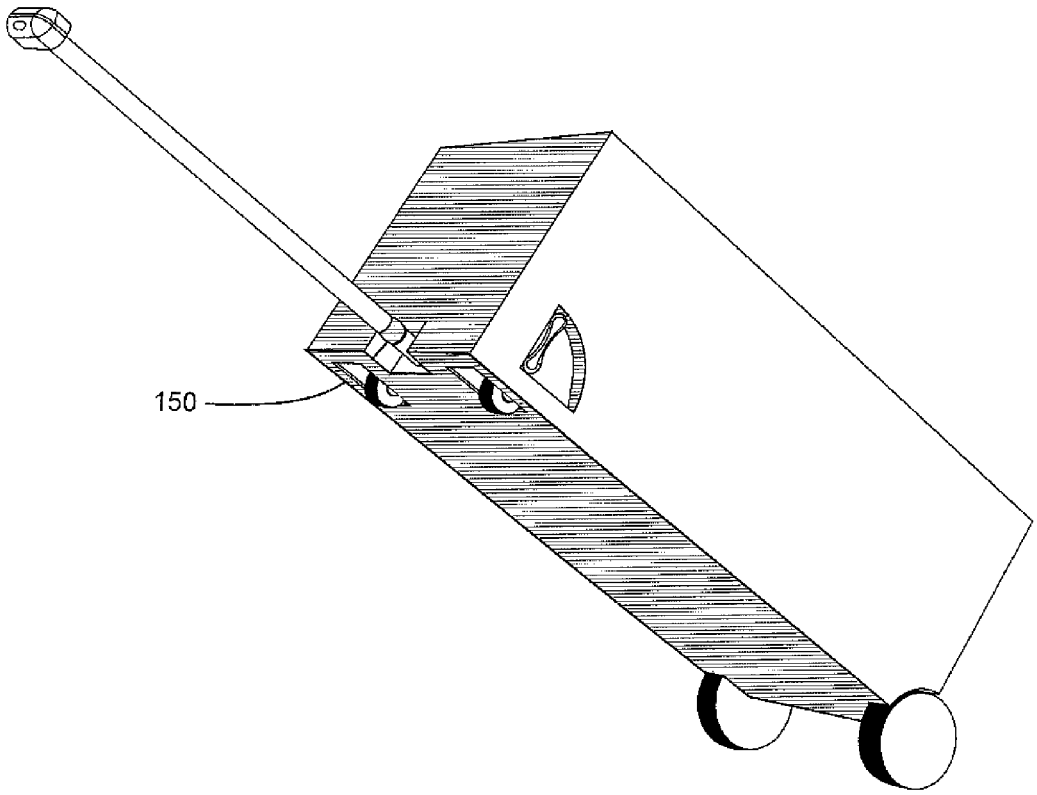
FIG. 27 is a perspective rear-side view of a pull-cart embodiment of the invention with the handle fully extended.
Figure 28:
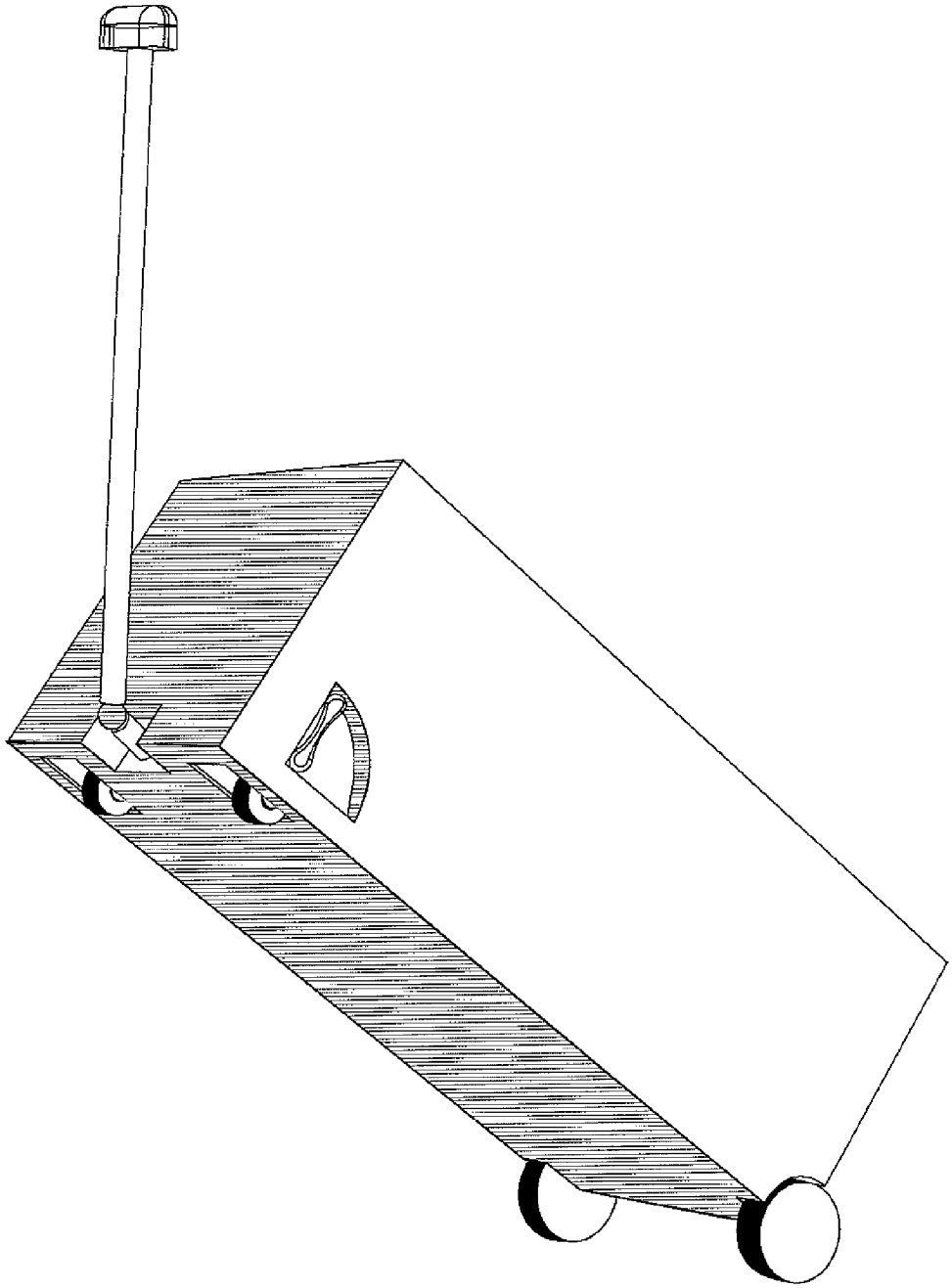
FIG. 28 is a perspective rear-side view of a pull-cart embodiment of the invention with the handle in a fully extended position and rotated upward through the means of a ball and socket joint.

Referring to FIG. 26, in use, handle 141 is pulled out from within the channel 142 until it is fully extended as shown in FIG. 27. Once fully extended, a joint that connects handle 141 to the main body 11 of the suitcase is exposed. In a preferred embodiment, joint 150 is a ball and socket joint, which facilitates maximal rotation of handle 141. For example, FIG. 28 shows an embodiment of the invention wherein handle 141 is rotated upwardly as facilitated by the ball and socket joint. It will be understood by those skilled in the art that handle 141 can be attached to the main body 11 of the suitcase by any of various mechanical joints such as hinges, springs, ring couplings and the like.

Alternatively, handle 141 or portions thereof can be fashioned out of a thick bendable material such as thick leather, rubber, plastic, PVC or a synthetic material with similar properties. In this embodiment, handle 141 can be directly joined to main body 11 and will be free to move in a wide range of directions because of the bendable quality of its constituent material, even without a mechanical joint coupling.

In an embodiment, handle 141 is utilized as a handle for the suitcase when it is used as a traditional wheelie bag. In this embodiment, handle 141, when not fully extended can be locked into position, for example by way of detent mechanisms which are well known in the art.

In another embodiment, the inventive suitcase is provided with a two separate handles. For example, a handle with a cross-bar 20 can be provided for use of the suitcase in its wheelie bag configuration, whereas a separate handle 141 can be provided for use of the suitcase in a pull-cart configuration.

Having described the invention with respect to specific embodiments and the exemplary attached drawings, it should be understood that the foregoing description is not intended to limit the scope of the present invention but merely serves as examples as how one of ordinary skill in the art can make or use the invention.

What is claimed is:

1. A convertible pushcart suitcase comprising:

a suitcase having a main body comprising at least a rear surface and a bottom surface;

a channel for receiving a retractable handle;

a retractable handle connected to said suitcase, said retractable handle being movable toward and away from said main body;

a first set of wheels provided on said bottom surface of said main body;

wheel wells for receiving a second set of wheels;

said second set of wheels disposed in said wheel wells, said wheels being retractable;

wherein said retractable handle is movable between a position being within said channel and horizontal to said bottom surface of said suitcase and a position being substantially orthogonal to said main body of said suitcase, said handle being used by a user in either said horizontal position or in said orthogonal position; and wherein when said retractable handle is in said horizontal position, said first pair of wheels is used to wheel said suitcase, and wherein when said retractable handle is in pulled out of said channel said second set of wheels slide out from said wheel wells and are positioned on said bottom surface of said main body and said first and second sets of wheels being are used to wheel said suitcase.

2. The convertible pushcart of claim 1, wherein said retractable handle comprises at least two side members and a cross bar.

3. The convertible pushcart of claim 2, wherein each of said at least two side members comprise at least two telescoping members.

4. The convertible pushcart of claim 2, wherein said second set of wheels comprises at least one wheel attached to a distal end of each of said at least two side members.

5. The convertible pushcart of claim 4, further comprising casters for attaching said at least one wheel to said distal end of each of said side members.

6. The pushcart of claim 2, wherein said cross bar is coated with at least one of textile, synthetic fiber, nylon, mylar, plastic or leather.

7. The convertible pushcart of claim 1, wherein said first set of wheels comprises at least two wheels fixed to said bottom surface of said main body.

8. The convertible pushcart of claim 1, wherein said retractable handle is coupled to a lower bar, said retractable handle pivoting about the longitudinal axis of said lower bar.

9. The convertible pushcart of claim 8, further comprising a coupling ring for coupling said retractable handle to said lower bar.

10. The convertible pushcart of claim 9, wherein side members of said retractable handle can be pulled through said coupling ring.

11. The convertible pushcart of claim 1, further comprising a channel for receiving said retractable handle.

12. The convertible pushcart of claim 1, wherein said retractable handle is stored on an outside surface of said suitcase.

13. The convertible pushcart of claim 1, further comprising a rigid frame.

14. The convertible pushcart of claim 13, wherein outer surfaces of said suitcase is attached to said rigid frame.

15. The pushcart of claim 14, wherein said outer surfaces comprise of material comprising at least one of plastic, mylar, PVC, fabric, textile, leather, synthetic leather, nylon, or metal.

16. The convertible pushcart of claim 1, further comprising a recess on said rear surface of said main body, said recess being adapted to receive said retractable handle.

17. The convertible pushcart of claim 1, further comprising at least a c-clamp disposed on said rear surface of said main body, said c-clamp being adapted to receive said retractable handle.

* * * * *